US007548226B2

(12) United States Patent
Sawabe

(10) Patent No.: US 7,548,226 B2
(45) Date of Patent: Jun. 16, 2009

(54) LIQUID CRYSTAL DISPLAY

(75) Inventor: Daiichi Sawabe, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 932 days.

(21) Appl. No.: 11/001,180

(22) Filed: Dec. 2, 2004

(65) Prior Publication Data

US 2005/0122295 A1 Jun. 9, 2005

(30) Foreign Application Priority Data

Dec. 4, 2003 (JP) ..... 2003-406282
Nov. 1, 2004 (JP) ..... 2004-318171

(51) Int. Cl.
*G09G 3/36* (2006.01)

(52) U.S. Cl. ..... 345/96; 345/87; 345/100

(58) Field of Classification Search ..... 345/87–100, 345/204

See application file for complete search history.

(56) References Cited

U.S. PATENT DOCUMENTS

| | | | | |
|---|---|---|---|---|
| 6,549,187 | B1 | 4/2003 | Matsubara et al. | |
| 6,583,778 | B1 | 6/2003 | Nishimura et al. | |
| 2002/0024482 | A1 * | 2/2002 | Song et al. | 345/87 |
| 2002/0097214 | A1 * | 7/2002 | Song | 345/96 |
| 2003/0043105 | A1 * | 3/2003 | Hirakata | 345/96 |
| 2003/0048248 | A1 | 3/2003 | Fukumoto et al. | |
| 2003/0058213 | A1 * | 3/2003 | Okada | 345/96 |
| 2003/0122770 | A1 | 7/2003 | Nishimura et al. | |
| 2003/0156092 | A1 | 8/2003 | Suzuki et al. | |

FOREIGN PATENT DOCUMENTS

| | | |
|---|---|---|
| EP | 1 551 004 A2 | 7/2005 |
| JP | 63-074036 | 4/1988 |
| JP | 2-168229 A | 6/1990 |
| JP | 08-334743 | 12/1996 |
| JP | 10-039837 | 2/1998 |
| JP | 10-111491 | 4/1998 |
| JP | 11-038379 A | 2/1999 |
| JP | 11-352462 | 12/1999 |

(Continued)

OTHER PUBLICATIONS

Japanese Office Action mailed May 7, 2008 with English Translation for a corresponding JP application.

(Continued)

*Primary Examiner*—Richard Hjerpe
*Assistant Examiner*—Kimnhung Nguyen
(74) *Attorney, Agent, or Firm*—Harness, Dickey & Pierce, P.L.C.

(57) ABSTRACT

A liquid crystal display is driven at, for example, a frame frequency of 100 Hz or higher. There are provided a base-4 frame counter 2 and a source control signal generator section controlling the polarity of the liquid crystal in pixels so as to alternately repeat, for each frame, a horizontal reversal once every m lines (m is 2 or a greater positive integer) and a horizontal reversal once every m lines after shifting the polarity of the lines in the preceding frame by n lines (n is a positive integer equal to a half or less of m). The provision achieves a liquid crystal display and a method of driving the display, addresses insufficient charging at higher frame frequencies and accomplishing higher display quality.

29 Claims, 28 Drawing Sheets

FOREIGN PATENT DOCUMENTS

| | | |
|---|---|---|
| JP | 2001-13480 | 2/2001 |
| JP | 2001-042831 | 2/2001 |
| JP | 2003-84725 | 3/2003 |
| JP | 2003-241721 | 8/2003 |
| KR | 2001-0017524 | 3/2001 |
| KR | 2003-0016717 | 3/2003 |
| KR | 2003-0058140 | 7/2003 |

OTHER PUBLICATIONS

Korean Office Action dated Jun. 15, 2006 for corresponding Korean patent application 10-2004-0101057, and English translation thereof.

* cited by examiner

FIG. 4

| READING ON BASE-4 FRAME COUNTER / LINE NUMBER | 0 | 1 | 2 | 3 |
|---|---|---|---|---|
| 1 | 1 | 1 | 0 | 0 |
| 2 | 1 | 0 | 0 | 1 |
| 3 | 0 | 0 | 1 | 1 |
| 4 | 0 | 1 | 1 | 0 |
| 5 | 1 | 1 | 0 | 0 |
| 6 | 1 | 0 | 0 | 1 |
| 7 | 0 | 0 | 1 | 1 |
| 8 | 0 | 1 | 1 | 0 |
| 9 | 1 | 1 | 0 | 0 |
| 10 | 1 | 0 | 0 | 1 |
| 11 | 0 | 0 | 1 | 1 |
| 12 | 0 | 1 | 1 | 0 |
| 13 | 1 | 1 | 0 | 0 |
| 14 | 1 | 0 | 0 | 1 |
| 15 | 0 | 0 | 1 | 1 |
| 16 | 0 | 1 | 1 | 0 |
| 17 | 1 | 1 | 0 | 0 |
| 18 | 1 | 0 | 0 | 1 |
| ⋮ | ⋮ | ⋮ | ⋮ | ⋮ |

FIG. 5 (a) POLARITY SIGNAL = 0

FIG. 8

| READING ON BASE-4 FRAME COUNTER / LINE NUMBER | 0 | 1 | 2 | 3 |
|---|---|---|---|---|
| 1 | LL | HH | LL | HH |
| 2 | HH | LL | HH | LL |
| 3 | LL | HH | LL | HH |
| 4 | HH | LL | HH | LL |
| 5 | LL | HH | LL | HH |
| 6 | HH | LL | HH | LL |
| 7 | LL | HH | LL | HH |
| 8 | HH | LL | HH | LL |
| 9 | LL | HH | LL | HH |
| 10 | HH | LL | HH | LL |
| 11 | LL | HH | LL | HH |
| 12 | HH | LL | HH | LL |
| 13 | LL | HH | LL | HH |
| 14 | HH | LL | HH | LL |
| 15 | LL | HH | LL | HH |
| 16 | HH | LL | HH | LL |
| 17 | LL | HH | LL | HH |
| 18 | HH | LL | HH | LL |
| ⋮ | ⋮ | ⋮ | ⋮ | ⋮ |

| READING ON BASE-4 FRAME COUNTER / LINE NUMBER | 0 | 1 | 2 | 3 |
|---|---|---|---|---|
| 1 | L | H | L | H |
| 2 | H | L | H | L |
| 3 | L | H | L | H |
| 4 | H | L | H | L |
| 5 | L | H | L | H |
| 6 | H | L | H | L |
| 7 | L | H | L | H |
| 8 | H | L | H | L |
| 9 | L | H | L | H |
| 10 | H | L | H | L |
| 11 | L | H | L | H |
| 12 | H | L | H | L |
| 13 | L | H | L | H |
| 14 | H | L | H | L |
| 15 | L | H | L | H |
| 16 | H | L | H | L |
| 17 | L | H | L | H |
| 18 | H | L | H | L |
| ⋮ | ⋮ | ⋮ | ⋮ | ⋮ |

FIG. 15

| READING ON BASE-4 FRAME COUNTER / LINE NUMBER | 0 | 1 | 2 | 3 |
|---|---|---|---|---|
| 1 | 1 | 0 | 0 | 1 |
| 2 | 1 | 1 | 0 | 0 |
| 3 | 0 | 0 | 1 | 1 |
| 4 | 0 | 1 | 1 | 0 |
| 5 | 1 | 0 | 0 | 1 |
| 6 | 1 | 1 | 0 | 0 |
| 7 | 0 | 0 | 1 | 1 |
| 8 | 0 | 1 | 1 | 0 |
| 9 | 1 | 0 | 0 | 1 |
| 10 | 1 | 1 | 0 | 0 |
| 11 | 0 | 0 | 1 | 1 |
| 12 | 0 | 1 | 1 | 0 |
| 13 | 1 | 0 | 0 | 1 |
| 14 | 1 | 1 | 0 | 0 |
| 15 | 0 | 0 | 1 | 1 |
| 16 | 0 | 1 | 1 | 0 |
| 17 | 1 | 0 | 0 | 1 |
| 18 | 1 | 1 | 0 | 0 |
| ⋮ | ⋮ | ⋮ | ⋮ | ⋮ |

FIG. 17

| READING ON BASE-4 FRAME COUNTER / LINE NUMBER | 0 | 1 | 2 | 3 |
|---|---|---|---|---|
| 1 | H | L | H | L |
| 2 | L | H | L | H |
| 3 | H | L | H | L |
| 4 | L | H | L | H |
| 5 | H | L | H | L |
| 6 | L | H | L | H |
| 7 | H | L | H | L |
| 8 | L | H | L | H |
| 9 | H | L | H | L |
| 10 | L | H | L | H |
| 11 | H | L | H | L |
| 12 | L | H | L | H |
| 13 | H | L | H | L |
| 14 | L | H | L | H |
| 15 | H | L | H | L |
| 16 | L | H | L | H |
| 17 | H | L | H | L |
| 18 | L | H | L | H |
| ⋮ | ⋮ | ⋮ | ⋮ | ⋮ |

FIG. 23

| POLARITY CHANGE | PRECHARGE GRAYSCALE LEVEL | ACTUAL CHARGE GRAYSCALE LEVEL | ACTUALLY APPLIED GRAYSCALE LEVEL |
|---|---|---|---|
| SAME POLARITY | 0 | 0 | 16 |
| SAME POLARITY | 1 | 0 | 18 |
| SAME POLARITY | 2 | 0 | 19 |
| SAME POLARITY | 3 | 0 | 21 |
| SAME POLARITY | 4 | 0 | 22 |
| | | | |
| SAME POLARITY | 0 | 1 | 17 |
| SAME POLARITY | 1 | 1 | 19 |
| SAME POLARITY | 2 | 1 | 20 |
| SAME POLARITY | 3 | 1 | 22 |
| | | | |
| OPPOSITE POLARITY | 0 | 0 | 16 |
| OPPOSITE POLARITY | 1 | 0 | 18 |
| OPPOSITE POLARITY | 2 | 0 | 19 |
| OPPOSITE POLARITY | 3 | 0 | 21 |
| OPPOSITE POLARITY | 4 | 0 | 22 |
| | | | |
| OPPOSITE POLARITY | 0 | 1 | 17 |
| OPPOSITE POLARITY | 1 | 1 | 19 |
| OPPOSITE POLARITY | 2 | 1 | 20 |
| OPPOSITE POLARITY | 3 | 1 | 22 |
| | | | |

FIG. 25

| READING ON BASE-6 FRAME COUNTER / LINE NUMBER | 0 | 1 | 2 | 3 | 4 | 5 |
|---|---|---|---|---|---|---|
| 1 | 1 | 1 | 1 | 0 | 0 | 0 |
| 2 | 1 | 1 | 0 | 0 | 0 | 1 |
| 3 | 1 | 0 | 0 | 0 | 1 | 1 |
| 4 | 0 | 0 | 0 | 1 | 1 | 1 |
| 5 | 0 | 0 | 1 | 1 | 1 | 0 |
| 6 | 0 | 1 | 1 | 1 | 0 | 0 |
| 7 | 1 | 1 | 1 | 0 | 0 | 0 |
| 8 | 1 | 1 | 0 | 0 | 0 | 1 |
| 9 | 1 | 0 | 0 | 0 | 1 | 1 |
| 10 | 0 | 0 | 0 | 1 | 1 | 1 |
| 11 | 0 | 0 | 1 | 1 | 1 | 0 |
| 12 | 0 | 1 | 1 | 1 | 0 | 0 |
| 13 | 1 | 1 | 1 | 0 | 0 | 0 |
| 14 | 1 | 1 | 0 | 0 | 0 | 1 |
| 15 | 1 | 0 | 0 | 0 | 1 | 1 |
| 16 | 0 | 0 | 0 | 1 | 1 | 1 |
| 17 | 0 | 0 | 1 | 1 | 1 | 0 |
| 18 | 0 | 1 | 1 | 1 | 0 | 0 |
| ⋮ | ⋮ | ⋮ | ⋮ | ⋮ | ⋮ | ⋮ |

FIG. 26

| READING ON BASE-6 FRAME COUNTER / LINE NUMBER | 0 | 1 | 2 | 3 | 4 | 5 |
|---|---|---|---|---|---|---|
| 1 | 0 | 1 | 1 | 0 | 0 | 0 |
| 2 | 1 | 1 | 0 | 0 | 0 | 1 |
| 3 | 0 | 0 | 0 | 1 | 1 | 1 |
| 4 | 0 | 1 | 1 | 1 | 0 | 0 |
| 5 | 1 | 1 | 0 | 0 | 0 | 1 |
| 6 | 0 | 0 | 0 | 1 | 1 | 1 |
| 7 | 0 | 1 | 1 | 1 | 0 | 0 |
| 8 | 1 | 1 | 0 | 0 | 0 | 1 |
| 9 | 0 | 0 | 0 | 1 | 1 | 1 |
| 10 | 0 | 1 | 1 | 1 | 0 | 0 |
| 11 | 1 | 1 | 0 | 0 | 0 | 1 |
| 12 | 0 | 0 | 0 | 1 | 1 | 1 |
| 13 | 0 | 1 | 1 | 1 | 0 | 0 |
| 14 | 1 | 1 | 0 | 0 | 0 | 1 |
| 15 | 0 | 0 | 0 | 1 | 1 | 1 |
| 16 | 0 | 1 | 1 | 1 | 0 | 0 |
| 17 | 1 | 1 | 0 | 0 | 0 | 1 |
| 18 | 0 | 0 | 0 | 1 | 1 | 1 |
| ⋮ | ⋮ | ⋮ | ⋮ | ⋮ | ⋮ | ⋮ |

FIG. 29

| GRAYSCALE LEVEL IN PRECEDING FRAME | GRAYSCALE LEVEL IN CURRENT FRAME | OS GRAYSCALE LEVEL |
|---|---|---|
| 0 | 0 | 0 |
| | ... | |
| 0 | 32 | 78 |
| | ... | |
| 0 | 64 | 117 |
| | ... | |
| 0 | 96 | 144 |
| | ... | |
| 0 | 128 | 178 |
| | ... | |
| 0 | 160 | 204 |
| | ... | |
| 0 | 192 | 222 |
| | ... | |
| 0 | 224 | 248 |
| | ... | |
| 0 | 255 | 255 |

FIG. 30

| GRAYSCALE LEVEL IN PRECEDING FRAME | GRAYSCALE LEVEL IN CURRENT FRAME | OS GRAYSCALE LEVEL |
|---|---|---|
| 0 | 224 | 248 |
| 0 | 225 | 248 |
| 0 | 226 | 248 |
| 0 | 227 | 248 |
| 0 | 228 | 249 |
| 0 | 229 | 249 |
| 0 | 230 | 249 |
| 0 | 231 | 249 |
| 0 | 232 | 250 |
| 0 | 233 | 250 |
| 0 | 234 | 250 |
| 0 | 235 | 250 |
| 0 | 236 | 251 |
| 0 | 237 | 251 |
| 0 | 238 | 251 |
| 0 | 239 | 251 |
| 0 | 240 | 252 |
| 0 | 241 | 252 |
| 0 | 242 | 252 |
| 0 | 243 | 252 |
| 0 | 244 | 253 |
| 0 | 245 | 253 |
| 0 | 246 | 253 |
| 0 | 247 | 253 |
| 0 | 248 | 254 |
| 0 | 249 | 254 |
| 0 | 250 | 254 |
| 0 | 251 | 254 |
| 0 | 252 | 255 |
| 0 | 253 | 255 |
| 0 | 254 | 255 |
| 0 | 255 | 255 |

LIQUID CRYSTAL DISPLAY

This Nonprovisional application claims priority under 35 U.S.C. § 119(a) on Patent Applications No. 2003-406282 and No. 2004-318171 filed in Japan on Dec. 4, 2003 and Nov. 1, 2004 respectively, the entire contents of which are hereby incorporated by reference.

FIELD OF THE INVENTION

The present invention relates to active matrix liquid crystal displays and their driving methods.

BACKGROUND OF THE INVENTION

Conventional liquid crystal displays for television sets operate at frame frequencies from 50 Hz through 60 Hz. Demands are however growing for those operating at double the frequency, i.e. 100 Hz to 120 Hz, to produce smooth motion pictures. Since liquid crystal is charged line by line according to an active matrix scheme, doubling the frame frequency means simply halving the charging time. A liquid crystal element is equivalent to a capacitor and is only insufficiently charged in half the charging time. The element does not reach the potential required for a display, which will result in an inaccurate grayscale display and poor display quality.

High definition displays needs increased numbers of scan lines representing each frame, reducing charging time per line and causing similar insufficient charging. This degrades display quality. For example, the number of lines of vertical scan lines of conventional television ranged from about 400 to 600. Meanwhile, coming high vision television has double that number at 1080 lines.

These issues are addressed by, for example, the conventional methods disclosed in Japanese published patent applications 2-168229 (Tokukaihei 2-168229/1990; published on Jun. 28, 1990) and 11-38379 (Tokukaihei 11-38379/1999; published on Feb. 12, 1999).

According to Tokukaihei 2-168229, the liquid crystal is driven (scanned) a line at a time; at the same timing, the liquid crystal is preliminarily scanned along at least another line. The preliminary scanning applies a voltage of a predicted value to pixels prior to actual scanning, and in practice adds to the scan period for that line. Thus, this approach prevents image quality degradation due to insufficient ON current.

According to Tokukaihei 11-38379, each scan signal line is fed with a scan signal during a secondary scan period. A data signal during that secondary scan period is diverted for the precharging of a cell. This approach allows a simple structure to cut down on the charging time of a cell in a primary scan period.

These techniques can solve insufficient charging.

However, the conventional liquid crystal display still entails insufficient charging when it is expected to produce a display at such high frame frequencies or a high-definition display with such largely increased numbers of horizontal lines as to halve the charging time.

SUMMARY OF THE INVENTION

The present invention has an objective to provide a liquid crystal display and its driving method which is capable of addressing insufficient charging even at high frame frequencies to achieve higher display quality.

A liquid crystal display of the present invention, to achieve the objective, is a liquid crystal display in which pixels are driven by active matrix drive and includes interframe polarity control means controlling to alternately repeat, for each frame, a first reversal pattern where a polarity of liquid crystal in the pixels is subjected to a horizontal reversal once every m lines (m is 2 or a greater positive integer) and a second reversal pattern where polarity reversal of lines in the first reversal pattern is shifted by n lines (n is a positive integer equal to a half or less of m).

A method of driving a liquid crystal display of the present invention, to achieve the objective, includes the steps of: driving pixels by active matrix drive; and alternately repeating, for each frame, a first reversal pattern subjecting a polarity of liquid crystal in the pixels to a horizontal reversal once every m lines (m is 2 or a greater positive integer) and a second reversal pattern where the polarity reversal of lines in the first reversal pattern is shifted by n lines (n is a positive integer equal to a half or less of m).

In other words, the conventional frame frequency of 50 Hz through 60 Hz is in some cases doubled to 100 Hz to 120 Hz to produce smooth moving images. In so doing, if the polarity of the pixels was reversed every frame as in conventional art, the charge time would be halved, resulting in insufficient charging.

Accordingly, in the present invention, the interframe polarity control means controls the polarity of the liquid crystal in the pixels so that a first reversal pattern subjecting the polarity of the liquid crystal in the pixels to a horizontal reversal once every m lines (m is 2 or a greater positive integer) and a second reversal pattern shifting the polarity reversal of the lines in the first reversal pattern by n lines (n is a positive integer equal to a half or less of m) are alternately repeated for each frame.

As a result, a reversal takes place with at least two frames as a unit. Replacing with the conventional frame frequency of 50 Hz through 60 Hz, the human eye will perceive as an average of sufficient charging and insufficient charging due to a polarity change.

Thus, the liquid crystal display is realized which addresses insufficient charging and achieves higher display quality even at high frame frequencies.

The frame frequency for the active matrix drive is preferably 100 Hz or higher. It may be however 50 Hz or higher for the following reasons.

A conventional technique exists whereby the grayscale level r and the grayscale level s are alternately displayed between frames to produce an intermediate grayscale level as part of pseudo-grayscale level technology (whereby the number of apparent grayscale levels is increased by, for example, simulating 8-bit color reproduction on hardware capable of 6-bit color reproduction). With this technique, grayscale levels can be averaged at ordinary frame frequencies of 50 Hz through 60 Hz. Thus, the technique of the present invention can be implemented also at 50 to 60 Hz. Note that the pseudo-grayscale level technology still causes some display quality degradation. When display quality is the priority, it is desirable if the invention is implemented at 100 Hz or higher frame frequencies which is double the conventional frame frequencies.

Another liquid crystal display of the present invention, to achieve the objective, is a liquid crystal display in which pixels are driven by active matrix drive where a frame frequency is 100 Hz or higher, and includes interframe polarity control means controlling a polarity of liquid crystal in the pixels every so that a horizontal reversal for every two lines and a horizontal reversal for every line are alternately repeated for each frame.

Another method of driving a liquid crystal display in the present invention, to achieve the objective, includes the steps of: driving pixels by active matrix drive at a frame frequency of 100 Hz or higher; and alternately repeating, for each frame, a horizontal reversal for every two lines and a horizontal reversal for every line with respect to a polarity of liquid crystal in the pixels.

According to the invention, the interframe polarity control means controls the polarity of the liquid crystal in the pixels so that a horizontal reversal for every two lines and a horizontal reversal for every line are alternately repeated for each frame.

Therefore, each pixels switches polarity only once every two frames. However, since the use of double the frame frequency or higher is a condition, the resultant frequency is equal to that in conventional once-per-frame switching. Also, the reversal pattern is complex in comparison with conventional cases because of the alternate repetition of a horizontal reversal for every two lines and a horizontal reversal for every line. The nature of flickering thus becomes more difficult to perceive in comparison with conventional cases.

Another liquid crystal display of the present invention, to achieve the objective, is a liquid crystal display in which pixels are driven by active matrix drive, wherein a frame frequency is 100 Hz or higher; and the display includes polarity control means subjecting, for each frame, a polarity of liquid crystal in the pixels to a horizontal reversal once for a number of lines.

Another method of driving a liquid crystal display of the present invention, to achieve the objective, includes the steps of: driving pixels by active matrix drive at a frame frequency of 100 Hz or higher; and subjecting a polarity of liquid crystal in the pixels to a horizontal reversal for a number of lines for each frame.

In other words, when the conventional frame frequency of 50 Hz through 60 Hz is, for example, doubled to 100 Hz through 120 Hz to produce smooth moving images, if the polarity of the pixels was reversed every frame as in conventional art, the charge time would be halved, resulting in insufficient charging.

However, According to the present invention, the polarity control means subjects, for each frame, a polarity of liquid crystal in the pixels to a horizontal reversal once for a number of lines.

Therefore, for example, when the frame frequency is double the conventional frame frequency, by implementing a horizontal reversal once every two lines, as a result, the same display quality as at the conventional frame frequency of 50 Hz through 60 Hz is achieved.

Additional objects, advantages and novel features of the invention will be set forth in part in the description which follows, and in part will become apparent to those skilled in the art upon examination of the following or may be learned by practice of the invention.

BRIEF DESCRIPTION OF THE DRAWINGS

FIG. 4 shows a polarity signal output supplied to lines from a source control signal generator section based on a base-4 frame counter in the liquid crystal display.

FIG. 5(*b*) is a plan view representing the polarity of liquid crystal in the subpixels of a line when the polarity signal is [1].

FIG. 8 shows the previous polarity of subpixels in the liquid crystal display.

FIG. 15, relating to another embodiment of the liquid crystal display in accordance with the present invention, shows a polarity signal output from a source control signal generator section in the liquid crystal display.

FIG. 17 shows the previous polarity of subpixels in the liquid crystal display in FIG. 15.

FIG. 23, relating to another embodiment of the liquid crystal display in accordance with the present invention, shows a lookup table representing relationships between the precharge voltage, the actual charge voltage, and the actually applied voltage in terms of grayscale levels, in relation to attributes of the preceding frame.

FIG. 25 shows a polarity signal output supplied to lines from a source control signal generator section based on a base-6 frame counter in the liquid crystal display when the polarity of pixels is to be reversed.

FIG. 26 shows a polarity signal output supplied to lines from a source control signal generator section based on a base-6 frame counter in the liquid crystal display when the polarity of pixels is to be reversed so that a horizontal reversal occurs every two lines for some lines and every line for other lines in each frame.

FIG. 29 is a drawing illustrating an overshoot grayscale level required by the liquid crystal display to make a transition from grayscale level 0 to a current frame grayscale level.

FIG. 30 is a drawing illustrating an overshoot grayscale level required by the liquid crystal display to make a transition from grayscale level 0 to current frame grayscale levels 224 to 255.

DESCRIPTION OF THE EMBODIMENTS

Embodiment 1

The following will describe an embodiment of the present invention in reference to FIG. 1 through FIG. 8.

Figure 1:
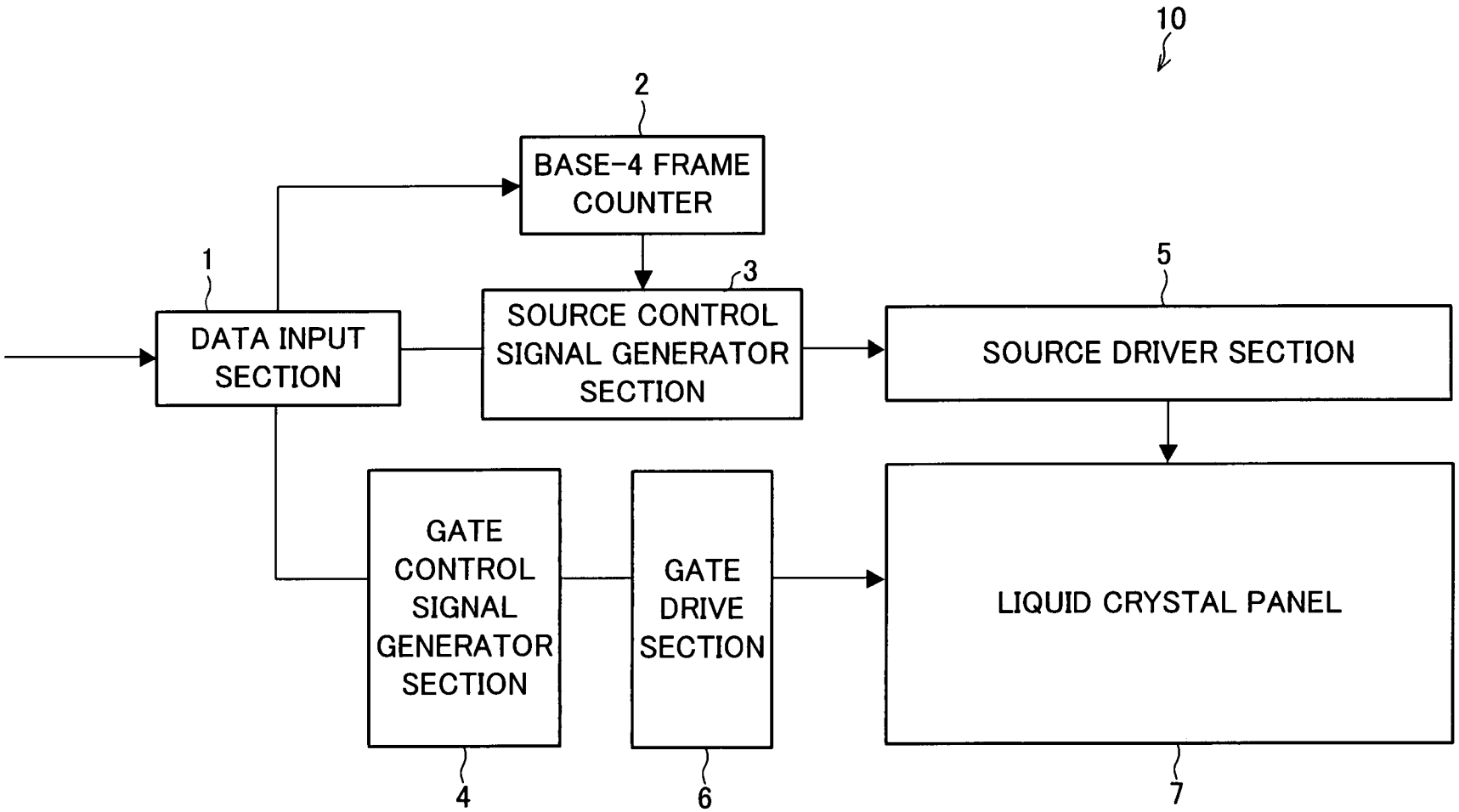
FIG. 1 is a block diagram illustrating an embodiment of the liquid crystal display in accordance with the present invention.

A liquid crystal display 10, as the display of the present embodiment, is connected a PC (personal computer), TV tuner, or like device that outputs image data. As shown in FIG. 1, the display 10 includes a data input section 1, a base-4 frame counter 2, a source control signal generator section 3, a gate control signal generator section 4, a source driver section (source drive means) 5, a gate drive section (gate drive means) 6, a liquid crystal panel 7, and a backlight (not shown in the figure).

Figure 2:
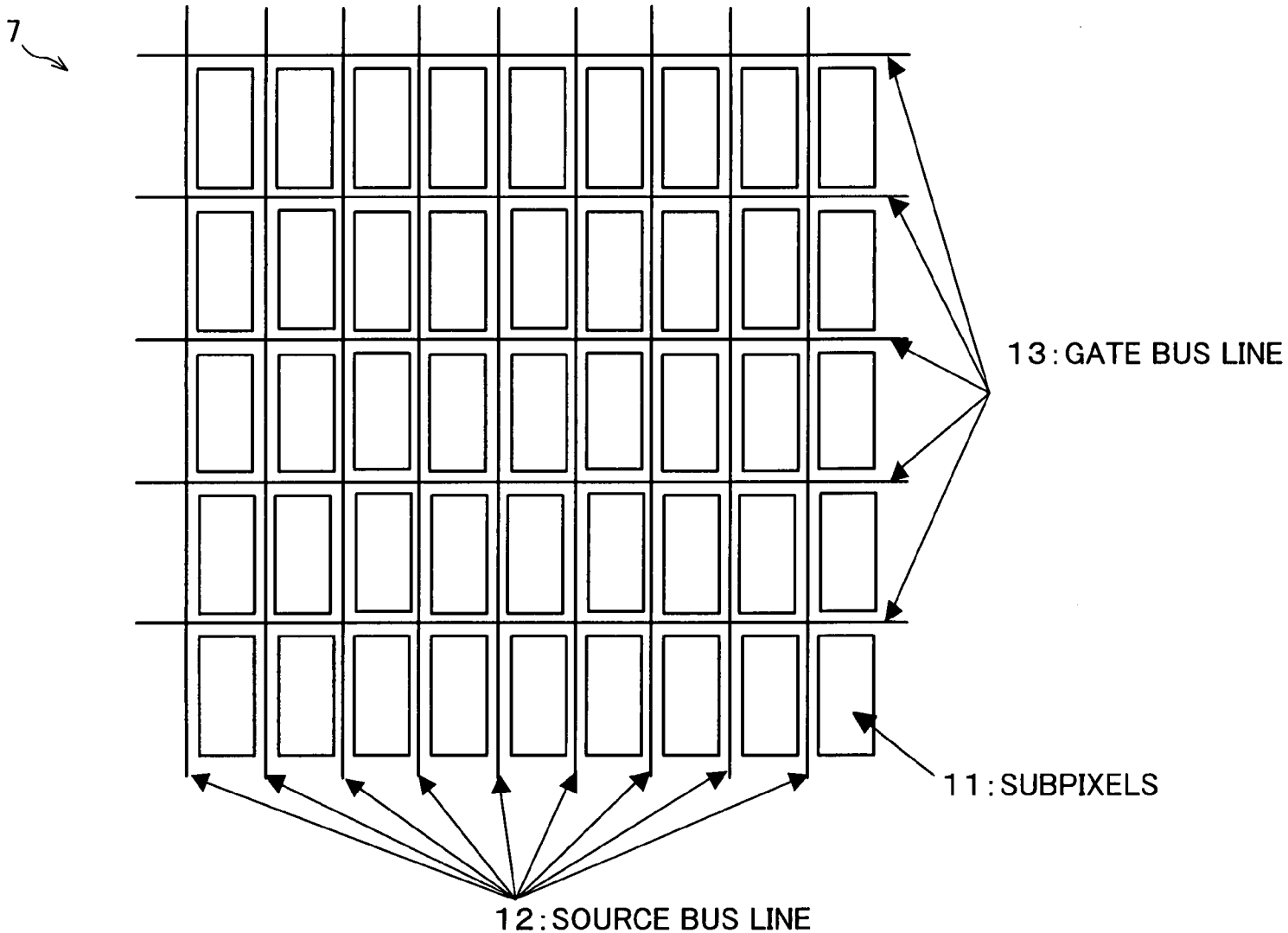
FIG. 2 is a plan view illustrating the matrix arrangement of subpixels in the liquid crystal panel of the liquid crystal display.
Figure 3:
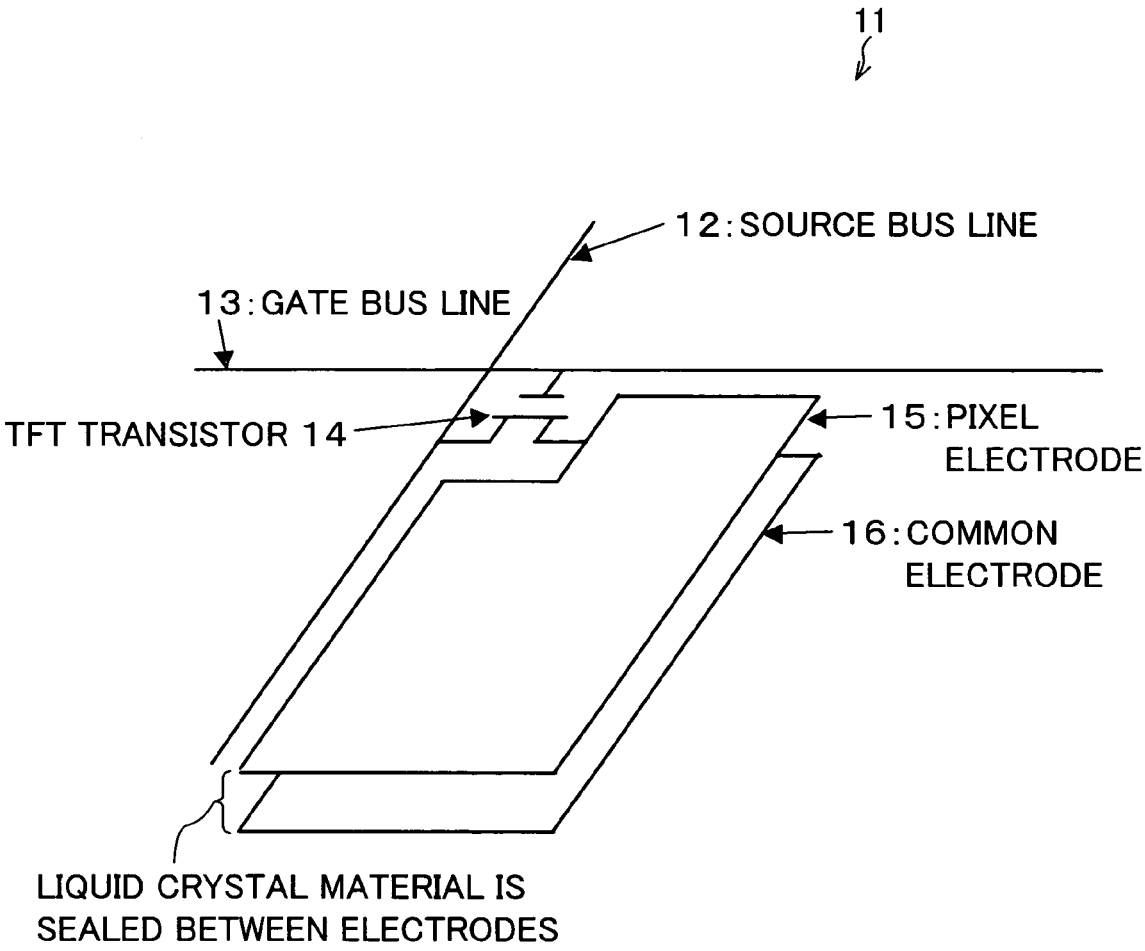
FIG. 3 is a perspective view illustrating the structure of a subpixel in the liquid crystal panel of the liquid crystal display.

The liquid crystal panel 7 contains a matrix array of subpixels 11 as shown in FIG. 2. FIG. 3 is a close-up of a subpixel 11, includes a source bus line 12, a gate bus line 13, a TFT transistor 14, a pixel electrode 15, and a common electrode 16.

The data input section 1 in FIG. 1 receives an input signal from an external device (not shown), detects the edges of frames and lines from input signals in reference to synchronization signals, and sends signals indicating edge detections to the base-4 frame counter 2, the source control signal generator section 3, and the gate control signal generator section 4.

The base-4 frame counter 2 is a base-4 counter for frame edges. The counter increments: "0, 1, 2, 3, 0, 1, 2 . . . " The count is sent to the source control signal generator section 3.

The source control signal generator section 3 generates control signals dictating the operation of the source driver section 5, including clocks, source start pulses, latch pulses, a polarity signal, and image data for the pixels. The polarity signal is determined based on a line number and a count given by the base-4 frame counter 2 in reference to the table in FIG. 4. That is, either the polarity signal [0] or [1] shown in FIG. 4 is output depending on a line number and a count given by the base-4 frame counter 2. Therefore, the source control signal generator section 3 and the base-4 frame counter 2 operate as interframe polarity control means in accordance with the present invention.

The control signals are sent to the source driver section 5. The gate control signal generator section 4 generates a gate clock and gate start pulses dictating the operation of the gate drive section 6 to send data to the gate drive section 6.

The source driver section 5 applies voltage to the source bus lines 12 of the liquid crystal panel 7 in accordance with the source control signals. The gate drive section 6 applies voltage to the gate bus lines 13 sequentially, a line at a time in accordance with the gate control signals.

The liquid crystal panel 7, which is an image display device, is constructed of a matrix of subpixels 11.

The backlight (not shown) is disposed behind the liquid crystal panel 7, to supply light to the liquid crystal panel 7.

The source bus lines 12 are provided as many as the columns of subpixels 11. The lines 12 are disposed in vertical power supply lines in the liquid crystal panel 7. Each source bus line 12 connects the source driver section 5 to the TFT transistors 14 in the associated column of subpixels 11.

The gate bus lines 13 are provided as many as the rows of subpixels 11. The lines 13 are disposed in horizontal power supply lines in the liquid crystal panel 7. Each gate bus line 13 connects the gate drive section 6 to the TFT transistors 14 in the associated row of subpixels 11.

Each TFT transistor 14 is a transistor device, applying the voltage on the source bus line 12 to the pixel electrode 15 when the voltage on the gate bus line 13 is greater than the voltage on the source bus line 12.

The pixel electrode 7 is formed on a panel glass sheet. The common electrode 16 is formed on another panel glass sheet. A voltage called a common voltage is applied to the common electrode 16.

Liquid crystal is enclosed between the panel glass sheets. The pixel electrodes 15 and the common electrode 16, provided respectively in the top and bottom panels, develop an electric field across the liquid crystal so as to move the liquid crystal molecule therein.

Now, the present embodiment will be described in detail in terms of operation.

Assume that the data input section 1 receives signals at a frame frequency of 120 Hz which is double the ordinary frame frequency of 60 Hz. Also, assume dot-reversal drive as the drive scheme.

First, the data input section 1 detects the edges of frames and lines from input signals in reference to synchronization signals, and sends signals indicating edge detections to the base-4 frame counter 2. The base-4 frame counter 2 counts those frame edge detection signals. The counter works in the base-4 number system and increments: "0, 1, 2, 3, 0, 1, 2, 3, 0, 1, . . . "

The source control signal generator section 3 receives the line edge detection signals and image data from the data input section 1 and the count from the base-4 frame counter 2, to generate control signals dictating the operation of the source driver section 5, including clocks, source start pulses, latch pulses, a polarity signal, and image data for the pixels.

Under these circumstances, a conventional liquid crystal module would reverse the polarity of the liquid crystal for each frame. In the present embodiment, polarity reversal takes place based on the polarity signal [0] and [1] as in FIG. 4, not for each frame.

Figure 5:
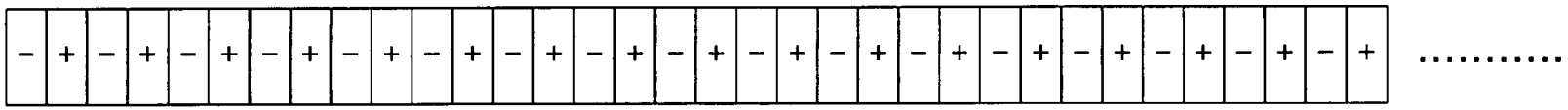
FIG. 5(*a*) is a plan view representing the polarity of liquid crystal in the subpixels of a line when the polarity signal is [0].

In the present embodiment, owing to the polarity signal [0] and [1], combined with the dot-reversal drive, the subpixels 11 in each row switch polarity as demonstrated in FIGS. 5(*a*), 5(*b*) in which the "+" symbol indicates the positive, and the symbol "−" the opposite.

Specifically, still referring to FIG. 4, when the base-4 counter reads 0, indicating a first frame, the polarity signal [1] is output during the horizontal period for line 1. Next, the polarity signal [1] is output similarly during the horizontal period for line 2. Then, the polarity signal [0] is output during the horizontal periods for lines 3, 4. In this manner, the polarity signal repeatedly switches between [1] and [0] for every two lines until the first frame is complete.

As the base-4 counter changes to read 1, indicating a second frame, the polarity signal [1] is output during the horizontal period for line 1. Next, the polarity signal [0] is output during the horizontal periods for lines 2, 3. Then, the polarity signal [1] is output during the horizontal periods for lines 4, 5. In this manner, the polarity signal repeatedly switches between [1] and [0] for every two lines until the second frame is complete.

As the base-4 counter changes further to read 2, indicating a third frame, the polarity signal [0] is output during the horizontal periods for lines 1, 2. Next, the polarity signal [1] is output during the horizontal periods for lines 3, 4. Then, the polarity signal [0] is output during the horizontal periods for lines 5, 6. In this manner, the polarity signal repeatedly switches between [1] and [0] for every two lines until the third frame is complete.

Moreover, as the base-4 counter changes to read 3, indicating a fourth frame, the polarity signal [0] is output during the horizontal period for line 1. Next, the polarity signal [1] is output during the horizontal periods for lines 2, 3. Then, the polarity signal [0] is output during the horizontal periods for lines 4, 5. In this manner, the polarity signal repeatedly switches between [1] and [0] for every two lines until the fourth frame is complete.

As to the succeeding frame, the base-4 counter returns to 0. The polarity signal changes between [0] and [1] as discussed in the above in accordance with the reading count (0 to 3) given by the base-4 counter.

According to this polarity reversal scheme, a horizontal reversal takes place once every two lines in the frame. Further, comparing the reversal control while the base-4 counter is reading 0, that is, in the first frame with the reversal control while the base-4 counter is reading 1, that is, in the second frame, the reversal control for the second frame differs from the reversal control for the first frame by an equivalent to one line. Similarly, the reversal control for the third frame differs from the reversal control for the second frame by an equivalent to one line. The reversal control for the fourth frame differs from the reversal control for the third frame by an equivalent to one line.

The polarity signal, either [0] or [1], characterized as above, is fed from the source control signal generator section 3 to the source driver section 5.

Next, the source driver section 5 applies a voltage to each source bus line 12 in accordance with the control signals. For example, for a common voltage of about 6 V, the positive voltage applied to the source bus line 12 will be set to 6 V to 12 V depending on the image data, whereas the opposite voltage applied will be set to 0 V to 6 V.

First, upon receiving frame edge and line edge information from the data input section 1, the gate control signal generator section 4 transmits control signals, including gate start pulses and a gate clock, which dictate the operation of the gate drive section 6, to the gate drive section 6. Upon receiving a gate start pulse, the gate drive section 6 applies HIGH voltage to line 1 and LOW voltage to the other lines. On the next rise of the gate clock, the section 6 applies HIGH voltage only to line 2 and LOW voltage to the other lines. On the succeeding rise of the gate clock, the section 6 applies HIGH voltage only to line 3 and LOW voltage to the other lines. The procedure is repeated for the following lines. In other words, the HIGH voltage line is shifted sequentially line by line.

The HIGH voltage applied to the gates is about 32 V to 36 V, whereas the LOW voltage is about −9 V to −6 V, as an example. Voltage is thus applied to the subpixels 11 line by line. Switching the voltage of the source bus line 12 with respect to a common potential alternates the polarity of the voltage applied to the liquid crystal. This polarity reversal prevents display quality degradation due to polarization of liquid crystal under a constant voltage. However, a brightness difference between the anode and the cathode, if present, is visible as flickering to the human eye. The visibility varies depending on the brightness difference and the frequency of changes.

In the case of the present embodiment, each pixel switches polarity only once every two frames. However, since the use of double the frame frequency is a condition, the resultant frequency is equal to that in conventional once-per-frame switching. The nature of flickering does not differ between the present embodiment and conventional art.

Doubling the frame frequency improves smoothness and continuity in playing video, producing crisp video playback. A disadvantage is that the horizontal period of the present embodiment, in which charging must be completed to drive the liquid crystal, is halved. This is the cause of insufficient charging which in turn results in the potential of the liquid crystal failing to reach a predetermined value and to produce a grayscale level display. Serious performance degradation ensues. Differences develop over time and across the screen between those regions where polarity is reversed and those where it is not. The differences are visible as, for example, stripes to the human eye. Further, white brightness falls in normally black mode, and black brightness rises in normally white mode. In other words, in normally white, a black display does not appear sufficiently black, but appears whitish under insufficient charging. This is an increased level of black brightness.

Figure 6:
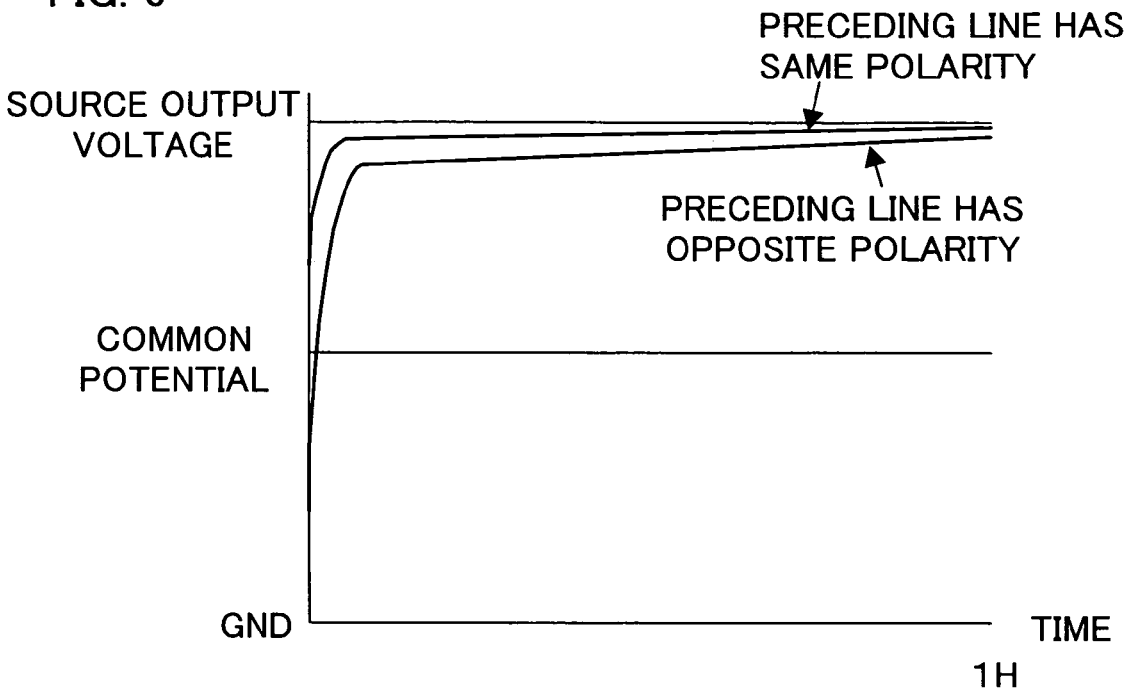
FIG. 6 is a waveform diagram demonstrating how a charging voltage for subpixels in the liquid crystal display changes with the polarity of the preceding line.

A cause of the insufficient charging is a voltage difference between the source bus line 12 which has the same polarity as the preceding line and that which has an opposite polarity to the preceding line, as shown in FIG. 6. This is a result of the horizontal reversal taking place once every two lines. FIG. 6 demonstrates a rising waveform. The same can be said about a falling waveform.

Figure 7:
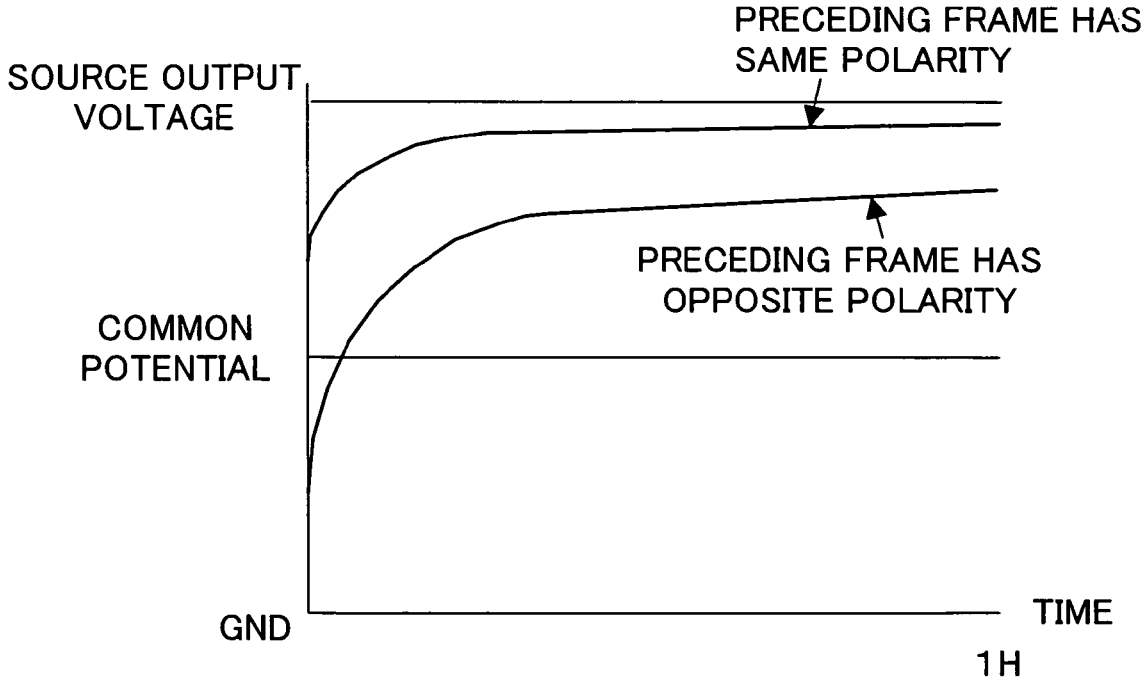
FIG. 7 is a waveform diagram demonstrating how a charging voltage for subpixels in the liquid crystal display changes with the polarity of the preceding frame.

Another cause of the insufficient charging, which can happen in the present embodiment, is a difference in voltage of the pixel electrodes 15 after charging, depending on whether the polarity is changed or maintained from the preceding frame, as shown in FIG. 7. This is a result of polarity being changed for some pixel electrodes and maintained for the other pixel electrodes between frames. FIG. 7 demonstrates a rising waveform. The same can be said about a falling waveform. The reversal of the present embodiment however is based on FIG. 4, thus ultimately achieving the polarity conditions shown in FIG. 8. Each symbol in the table is made up two letters, either "L" or "H." The left-hand letter refers to the polarity of the preceding line, with an L indicating an opposite polarity and an H indicating the same polarity. The right-hand letter refers to the polarity in the preceding frame, with an L indicating an opposite polarity and an H indicating the same polarity. "HH" shows the same charging taking place as at a frame frequency of 60 Hz, which results in sufficient charging. In contrast, "LL" shows the same charging taking place as a horizontal reversal for every line and for every frame at a frame frequency of 120 Hz.

This drive scheme causes changes in brightness over time. However, an alternation typically occurs at double the frame frequency and looks like an average of LL and HH to the human eye. This is because the difference in brightness between LL and HH is smaller than differences in brightness between typical moving images and hard to perceived for the human eye.

Brightness is unstable, and sufficient grayscale levels cannot be reproduced, when charging is insufficient. The problem is addressed by mixing with the HH brightness where a sufficient grayscale level display is achieved. Thus, stability, hence grayscale level reproduction ability, is improved.

With these measures implemented, in comparison with simply raising the frame frequency with conventional technology, grayscale level displays are produced in a more stable manner, and performance degradation where white brightness falls in normally black mode and black brightness rises in normally white mode is addressed, in 120 Hz drive.

The foregoing description has assumed dot reversal as an example. The same effects are achieved with simpler line reversal.

In this manner, in the liquid crystal display 10 of the present embodiment, the pixels are driven by an active matrix scheme at 100 Hz or higher frame frequencies. There is provided the base-4 frame counter 2 and the source control signal generator section 3 which control the polarity of the liquid crystal in the pixels so that a horizontal reversal for every two lines in each frame and a horizontal reversal for every two lines after shifting the polarity of the lines in the preceding frame by one line are alternately repeated.

In other words, the conventional frame frequency of 50 Hz through 60 Hz is in some cases doubled to 100 Hz to 120 Hz to produce smooth moving images. In so doing, if the polarity of the pixels was reversed every frame as in conventional art, the charge time would be halved, resulting in insufficient charging.

Accordingly, in the present embodiment, the base-4 frame counter 2 and the source control signal generator section 3 control the polarity of the liquid crystal in the pixels so that a horizontal reversal for every two lines in each frame and a horizontal reversal for every two lines after shifting the polarity of the lines in the preceding frame by one line are alternately repeated.

As a result, a reversal takes place with at least two frames as a unit. Therefore, the human eye will perceive as an average of sufficient charging and insufficient charging due to a polarity change, that is, the conventional frame frequency of 50 Hz through 60 Hz.

Thus, the liquid crystal display 10 is realized which addresses insufficient charging and achieves higher display quality even at high frame frequencies.

Further, in the liquid crystal display 10 of the present embodiment, the pixels are driven by an active matrix scheme at 100 Hz or higher frame frequencies. There is provided the base-4 frame counter 2 as polarity control means subjecting the polarity of the liquid crystal in the pixels to horizontal reversal once for a certain number of lines for each frame for each frame.

In other words, when the conventional frame frequency of 50 Hz through 60 Hz is, for example, doubled to 100 Hz through 120 Hz to produce smooth moving images, if the polarity of the pixels was reversed every frame as in conventional art, the charge time would be halved, resulting in insufficient charging.

However, according to the present embodiment, the base-4 frame counter 2 subjects the polarity of the liquid crystal in the pixels to horizontal reversal once for a certain number of lines for each frame.

Therefore, for example, when the frame frequency is double the conventional frame frequency, by implementing a horizontal reversal once every two lines, as a result, the same display quality as at the conventional frame frequency of 50 Hz through 60 Hz is achieved.

The foregoing description has assumed doubling the frame frequency. Alternatively, the embodiment can be implemented at the original frequency. It is conventionally known to alternately display the grayscale level r and the grayscale level s between frames to produce an intermediate grayscale level as part of pseudo-grayscale level technology (whereby the number of apparent grayscale levels is increased by, for example, simulating 8-bit color reproduction on hardware capable of 6-bit color reproduction). With this technique, grayscale levels can be averaged at ordinary frame frequencies of 50 Hz through 60 Hz. Thus, the technique of the present embodiment can be implemented also at 50 Hz through 60 Hz. Note that the pseudo-grayscale level technology still causes some display quality degradation. When display quality is the priority, it is desirable if the embodiment is implemented at 100 Hz or higher frame frequencies which is double the conventional frame frequencies.

In addition, in the liquid crystal display 10 of the present embodiment, are employed the liquid crystal panel 7, source drive section 5, and gate drive section 6 which are all typical. Therefore, in a liquid crystal display 10 containing a typical liquid crystal panel 7, source drive section 5, and gate drive section 6, insufficient charging is addressed and higher display quality is achieved even at high frame frequencies.

Embodiment 2

The following will describe another embodiment in accordance with the present invention in reference to FIG. 9 through FIG. 12. The present embodiment shares the arrangement as embodiment 1 unless otherwise stated. In addition, for convenience, members of the present embodiment that have the same arrangement and function as members of embodiment 1, and that are mentioned in that embodiment are indicated by the same reference numerals and description thereof is omitted.

As mentioned in embodiment 1, again in the present embodiment, the liquid crystal display 10 switches the polarity signal between [0] and [1] as shown in FIGS. 4, 5(*a*), 5(*b*).

Therefore, each pixel switches polarity only once every two frames. However, since the use of double the frame frequency is a condition, the resultant frequency is equal to that in conventional once-per-frame switching. The nature of flickering does not differ between the present embodiment and conventional art.

Doubling the frame frequency improves smoothness and continuity in playing video, producing crisp video playback. A disadvantage is that the horizontal period of the present embodiment, in which charging must be completed to drive the liquid crystal, is halved. This is the cause of insufficient charging which in turn results in the potential of the liquid crystal failing to reach a predetermined value and to produce a grayscale level display. Serious performance degradation ensues. Differences develop over time and across the screen between those regions where polarity is reversed and those where it is not. The differences are visible as, for example, stripes to the human eye. Further, white brightness falls in normally black mode, and black brightness rises in normally white mode. A cause of the insufficient charging is a voltage difference between the source bus line which has the same polarity as the preceding line and that which has an opposite polarity to the preceding line. This is due to the 2H reversal.

Figure 9:
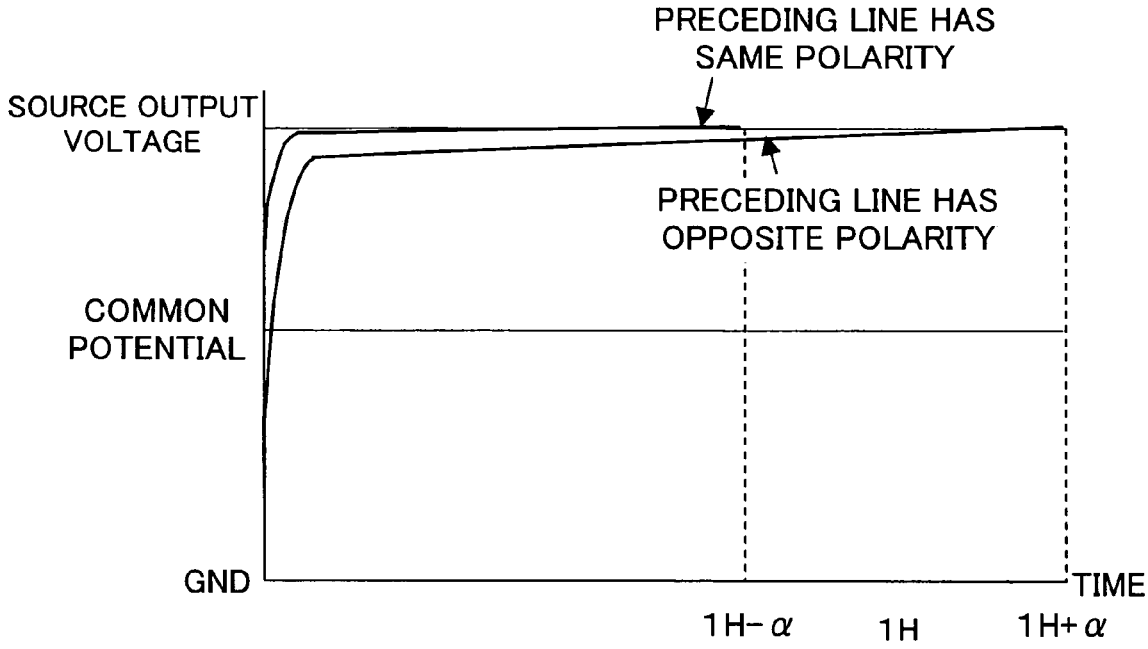
FIG. 9, relating to another embodiment of the liquid crystal display in accordance with the present invention, is a waveform diagram demonstrating how a charging voltage for subpixels in the liquid crystal display changes with the polarity of the preceding line.
Figure 10:
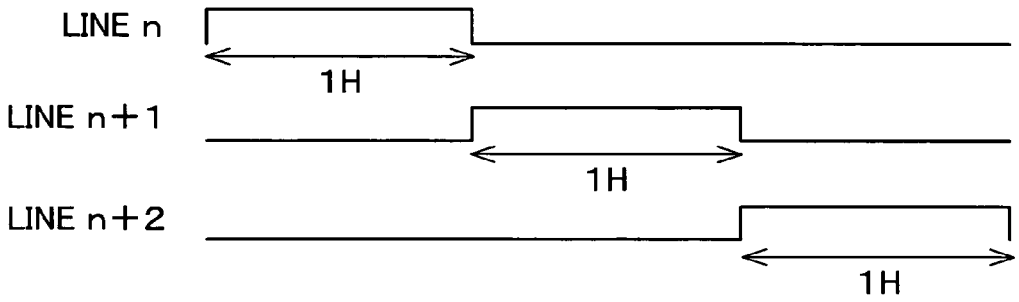
FIG. 10 is a waveform diagram showing timings in the liquid crystal display at a typical gate voltage.

Accordingly, in the present embodiment, as shown in FIG. 9, the charge time is varied depending on the polarity of the preceding line to eliminate the differences between the values reached by the voltages. In other words, The values reached by the voltages are made equal by selecting $\alpha$ in 1H-$\alpha$ when the preceding line has the same polarity and in 1H+-$\alpha$ when the preceding line has an opposite polarity. "1H" refers to the time of one horizontal scan period.

Figures 11, 12:
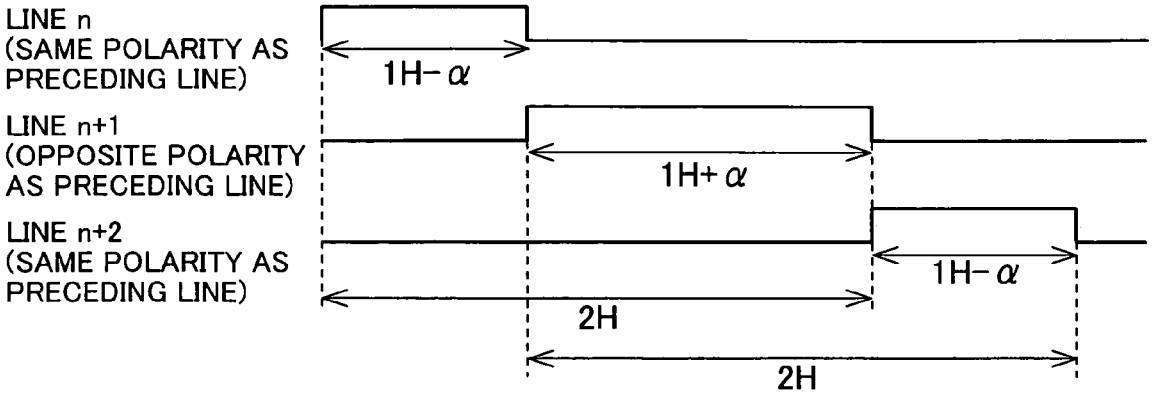
FIG. 11 is a waveform diagram showing timings of the gate voltage in the liquid crystal display in FIG. 9.
FIG. 12 shows the previous polarity of subpixels in the liquid crystal display in FIG. 9.

In the present embodiment, a reversal is implemented using 2H. The length equivalent to two lines is 1H$-\alpha$+1H+$\alpha$=2H, which is equal to the original length, 2H, of two lines. No surplus or shortage occurs in the process. The process is readily implemented by manipulating the pulses applied to the gate bus lines. In addition, the waveform, shown in FIG. 10, which is applied to the gate bus lines is readily realized by altering as shown in FIG. 11. The foregoing description has assumed positive changes. The same can be said about opposite changes.

Another cause of the insufficient charging, which can happen in present embodiment 2, is a difference in voltage of the pixel electrodes after charging, depending on whether the polarity is changed or maintained from the preceding frame, as shown in FIG. 7. This is a result of polarity being changed for some pixel electrodes and maintained for the other pixel electrodes between frames.

FIG. 7 demonstrates a rising waveform. The same can be said about a falling waveform. The reversal of the present embodiment however is based on FIG. 4, thus achieving the polarity conditions shown in FIG. 12.

In the figure, the "L" symbol indicates that the preceding line is of an opposite polarity, "H" indicates that the preceding line is of the same polarity. "H" shows the same charging taking place as at a frame frequency of 60 Hz, which results in sufficiently charging. "L" shows the same charging taking place as a 1H reversal 1-frame reversal at a frame frequency of 120 Hz.

The drive scheme causes changes in brightness over time. However, an alternation typically occurs at double the frame frequency and looks like an average of L and H to the human eye. This is because the difference in brightness between L and H is smaller than differences in brightness between typical moving images and hard to perceive for the human eye.

Brightness is unstable due to variations between liquid crystal panels 7 and other factors, and sufficiently grayscale levels cannot be reproduced, when charging is insufficient. The problem is addressed by mixing colors with the H brightness where a sufficient grayscale level display is achieved. Thus, stability, hence grayscale level reproduction ability, is improved.

With these measures implemented, in comparison with simply raising the frame frequency with conventional technology, grayscale level displays are produced in a more stable manner, and performance degradation where white brightness falls in normally black mode and black brightness rises in normally white mode is addressed, in 120 Hz drive.

Present embodiment 2 has assumed dot reversal. The same effects are achieved with simpler line reversal.

In this manner, in the liquid crystal display 10 of the present embodiment, there is provided the gate drive section 6 as gate drive means regulating the gate pulse width on each of the two lines during a horizontal scan period which covers two lines when implementing a horizontal reversal once every two lines.

In addition, in the liquid crystal display 10 of the present embodiment, the gate drive section 6 regulates the gate pulse width on each line in accordance with the polarity of the pixels in the preceding line.

In other words, charge insufficient occurs depending on whether the polarity of the pixels in the preceding line is of the same or opposite polarity, which appears like stripes to the human eye.

Accordingly, in the present embodiment, the gate drive section 6 regulates the gate pulse width on each of the two lines during a horizontal scan period which covers two lines when implementing a horizontal reversal once every two lines. Thus, even when the gate pulse width is increased/decreased in any of the lines, no problem occurs as a drive scheme provided that the widths as a whole make up a horizontal scan period covering two lines. In other words, it would suffice to increase the gate pulse width when charging is insufficient due to the relationship with the polarity in the preceding line and decrease, by the time of the width, the time for the gate pulse width where charge is sufficient due to the relationship with the polarity in the preceding line.

Thus, there can be provided the liquid crystal display 10 capable of addressing insufficient charging and achieving higher display quality.

Embodiment 3

Figure 13:
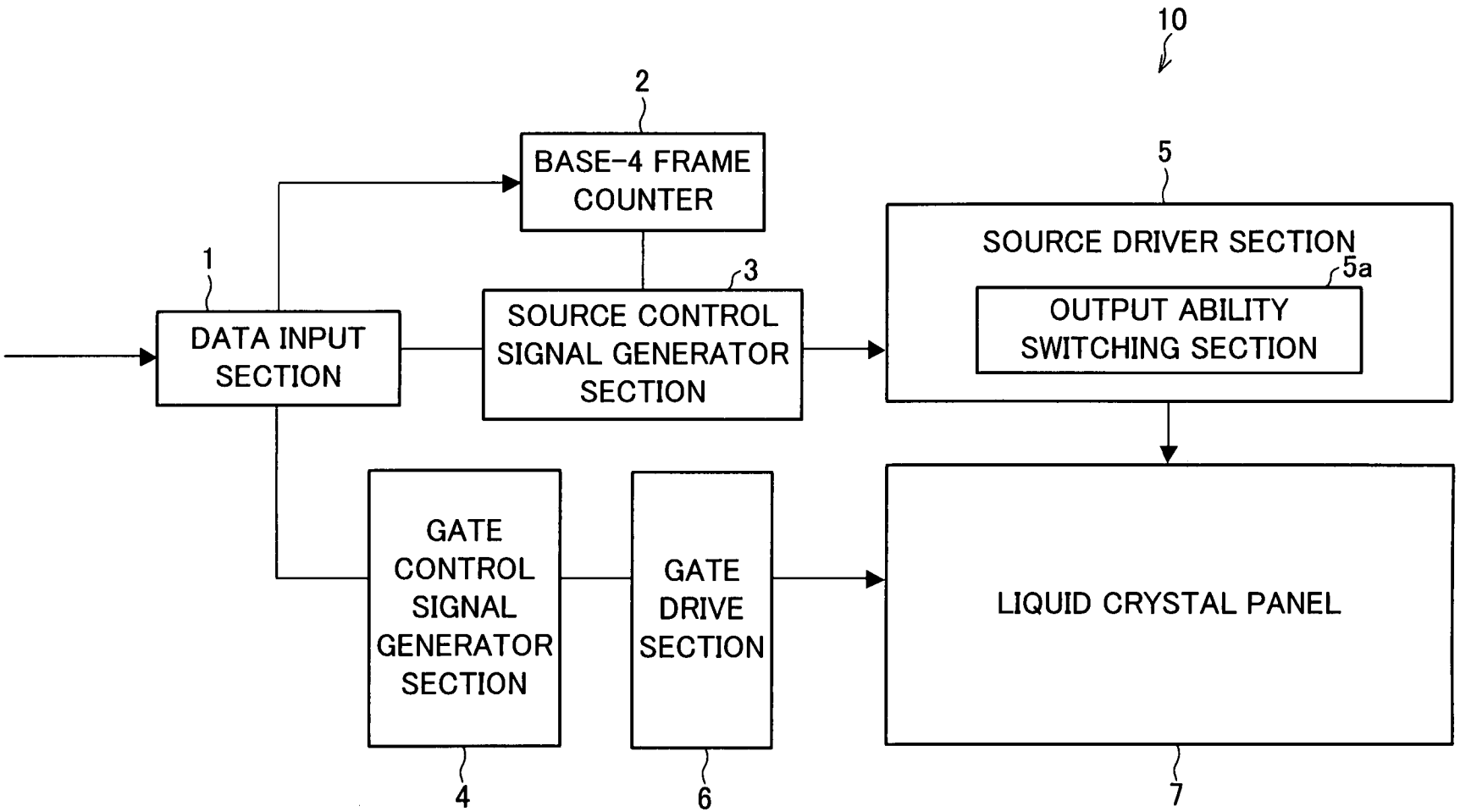
FIG. 13, relating to another embodiment of the liquid crystal display in accordance with the present invention, is a block diagram illustrating the arrangement of a liquid crystal display containing an output capability switching section in a source driver section.
Figure 14:
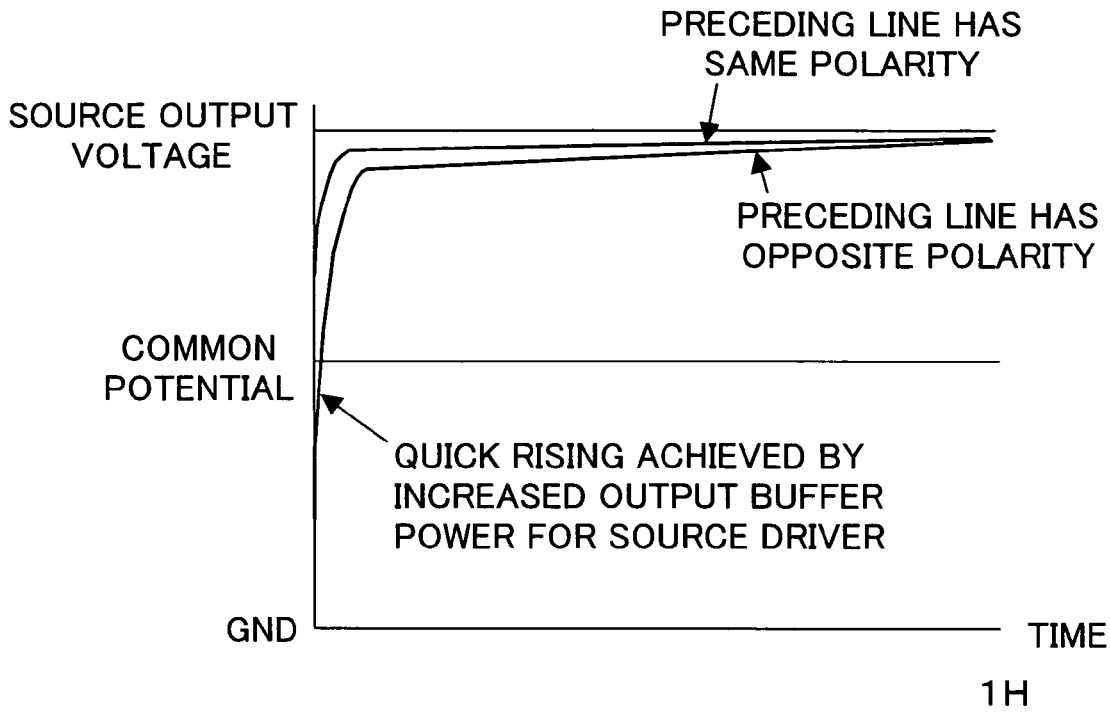
FIG. 14 is a waveform diagram demonstrating how a charging voltage for subpixels in the liquid crystal display changes with the polarity of the preceding line.

The following will describe another embodiment in accordance with the present invention in reference to FIG. 13 and FIG. 14. The present embodiment shares the arrangement as embodiments 1, 2 unless otherwise stated. In addition, for convenience, members of the present embodiment that have the same arrangement and function as members of embodiments 1, 2, and that are mentioned in that embodiment are indicated by the same reference numerals and description thereof is omitted.

As mentioned in embodiment 1, again in the present embodiment, the liquid crystal display 10 switches the polarity signal between [0] and [1] as shown in FIGS. 4, 5(*a*), 5(*b*).

Therefore, each pixel switches polarity only once every two frames. However, since the use of double the frame frequency is a condition, the resultant frequency is equal to that in conventional once-per-frame switching. The nature of flickering does not differ between the present embodiment and conventional art.

Doubling the frame frequency improves smoothness and continuity in playing video, producing crisp video playback. A disadvantage is that the horizontal period, in which charging must be completed to drive the liquid crystal, is halved. This is the cause of insufficient charging which in turn results in the potential of the liquid crystal failing to reach a predetermined value and to produce a grayscale level display. Serious performance degradation ensues. Differences develop over time and across the screen between those regions where polarity is reversed and those where it is not. The differences are visible as, for example, stripes to the human eye. Further, white brightness falls in normally black mode, and black brightness rises in normally white mode.

A cause of the insufficient charging is a voltage difference between the source bus line which has the same polarity as the preceding line and that which has an opposite polarity to the preceding line. This is due to the 2H reversal.

Accordingly, in present embodiment 3, since it is known in advance whether the preceding line is of the same or opposite polarity, as shown in FIG. 13, the source driver section 5 is provided with an output ability switching section 5*a* as source voltage switch means switching the output applied to the source bus lines 12. The output ability is switched between, for example, 16 mA when the preceding line has an opposite polarity and 8 mA when the preceding line has the same polarity.

Thus, since the rise rate of the voltage applied to the source bus lines 12 increases at high ability, as shown in FIG. 14, the voltage of the source bus lines 12 when the preceding line has the same polarity can be rendered equal to that when the preceding line has an opposite polarity.

Similarly to embodiment 1, another cause of the insufficient charging, which can happen in present embodiment 3, is a difference in voltage of the pixel electrodes after charging, depending on whether the polarity is changed or maintained from the preceding frame, as shown in FIG. 7. This is a result of polarity being changed for some pixel electrodes and maintained for the other pixel electrodes between frames. FIG. 7 demonstrates a rising waveform. The same can be said about a falling waveform. The reversal of present embodiment 3 however is based on FIG. 4, thus achieving the polarity conditions shown in FIG. 12. similarly to embodiment 2.

In the figure, the "L" symbol indicates that the preceding line is of an opposite polarity, "H" indicates that the preceding line is of the same polarity. Here, "H" shows the same charging taking place as at a frame frequency of 60 Hz, which results in sufficiently charging. "L" shows the same charging taking place as a 1H reversal 1-frame reversal at a frame frequency of 120 Hz.

This drive scheme causes changes in brightness over time. However, an alternation typically occurs at double the frame frequency and looks like an average of L and H to the human eye. This is because the difference in brightness between L and H is smaller than differences in brightness between typical moving images and hard to perceive for the human eye.

Brightness is unstable due to variations between liquid crystal panels 7 and other factors, and sufficient grayscale levels cannot be reproduced, when charging is insufficient. The problem is addressed by mixing colors with the H brightness where a sufficient grayscale level display is achieved. stability, hence grayscale level reproduction ability, is improved.

With these measures implemented, in comparison with simply raising the frame frequency with conventional technology, grayscale level displays are produced in a more stable manner, and performance degradation where white brightness falls in normally black mode and black brightness rises in normally white mode is addressed, in 120 Hz drive.

Present embodiment 3 has assumed dot reversal. The same effects are achieved with simpler line reversal.

In this manner, in the liquid crystal display 10 in accordance with the present invention, there is provided the source driver section 5 as source drive means regulating the source voltage output when implementing a horizontal reversal once every two lines.

In other words, charging may be insufficient in some cases in relation to the polarity in the preceding line when implementing a horizontal reversal once every two lines.

However, according to the present embodiment, the source driver section 5 regulates the source voltage output when implementing a horizontal reversal once every two lines. Specifically, when charging is insufficient in relation to the polarity in the preceding line, the charge action is quickly done by raising the source potential, eliminating insufficient charging.

In addition, in the liquid crystal display 10 of the present embodiment, there is provided the output ability switching section 5*a* regulating the source voltage output by switching the source voltage between two preset values in accordance with the polarity of the pixels in the preceding line. Thus, two types source voltages are specified, one for insufficient charging and the other for sufficient charging, between which the source voltage is switched. Therefore, the source voltage output can be readily regulated.

Embodiment 4

Figure 16:
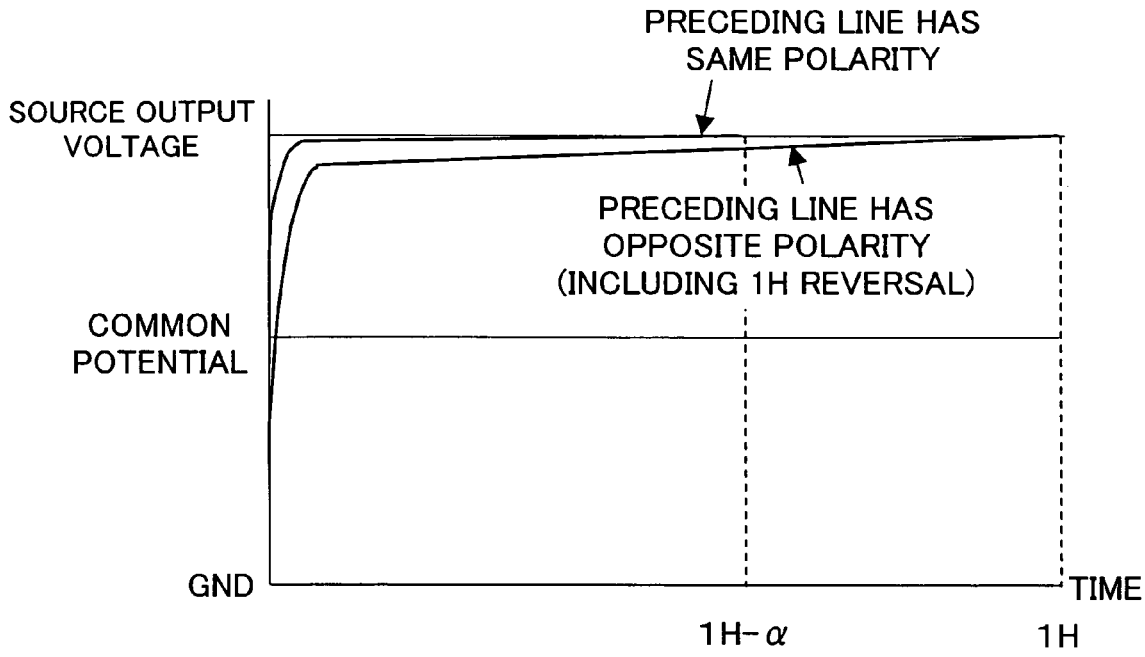
FIG. 16 is a waveform diagram demonstrating how a charging voltage for subpixels in the liquid crystal display changes with the polarity of the preceding line.

The following will describe another embodiment in accordance with the present invention in reference to FIG. 15 through FIG. 17. The present embodiment shares the arrangement as embodiment 1 through embodiment 3 unless otherwise stated. In addition, for convenience, members of the present embodiment that have the same arrangement and function as members of embodiments 1 to 3, and that are mentioned in that embodiment are indicated by the same reference numerals and description thereof is omitted.

In the liquid crystal display 10 of present embodiment 4, unlike in embodiment 1 to embodiment 3, the polarity signal is switched between [0] and [1] as shown in FIG. 15. In other words, control is done so that a horizontal reversal for every two lines and a horizontal reversal for every line are alternately repeated.

Specifically, as shown in FIG. 15, when the base-4 counter reads 0, indicating a first frame, the polarity signal [1] is output during the horizontal period for line 1 in the first frame. Next, the polarity signal [1] is output similarly also during the horizontal period for line 2. Then, the polarity signal [0] is output during the horizontal periods for lines 3, 4. In this manner, the polarity signal repeatedly switches between [1] and [0] for every two lines until the first frame is complete.

As the base-4 counter changes to read 1, indicating a second frame, the polarity signal [0] is output first during the horizontal period for line 1. Next, the polarity signal [1] is output during the horizontal period for line 2. Then, the polarity signal [0] is output during the horizontal period for line 3. During the horizontal period for line 4, the polarity signal [1] is output. In this manner, the polarity signal repeatedly switches between [0] and [1] for each line until the second frame is complete.

As the base-4 counter changes further to read 2, indicating a third frame, the polarity signal [0] is output during the horizontal periods for lines 1, 2. Next, the polarity signal [1] is output during the horizontal periods for lines 3, 4. Then, the polarity signal [0] is output during the horizontal periods for lines 5, 6. In this manner, the polarity signal repeatedly switches between [1] and [0], [0] for every two lines until the third frame is complete.

Moreover, as the base-4 counter changes to read 3, indicating a fourth frame, the polarity signal [1] is output first during the horizontal period for line 1. Then, the polarity signal [0] is output during the horizontal period for line 2. Then, the polarity signal [1] is output during the horizontal period for line 3. During the horizontal period for line 4, the polarity signal [0] is output. In this manner, the polarity signal repeatedly switches between [1] and [0] for each line until the fourth frame is complete.

As to the succeeding frame, the base-4 counter returns to 0. The polarity signal changes between [0] and [1] as discussed in the above in accordance with the reading count (0 to 3) given by the base-4 counter.

According to this polarity reversal scheme, a 2-horizontal reversal and a 1-horizontal reversal repeat alternately. The polarity signal, either [0] or [1], is fed from the source control signal generator section 3 to the source driver section 5.

Voltage is applied to the subpixels 11 a line at a time. The voltage of the source bus lines 12 reverses the voltage applied to the liquid crystal by changing the sign between "+" and "−" in reference to the common potential. This polarity reversal prevents display quality degradation due to polarization of liquid crystal under a constant voltage. However, a brightness difference between the anode and the cathode, if present, is visible as flickering to the human eye. The visibility varies depending on the brightness difference and the frequency of changes.

In the case of present embodiment 4, each pixel switches polarity only once every two frames. However, since the use of double the frame frequency is a condition, the resultant frequency is equal to that in conventional once-per-frame switching. The pattern specified in the FIG. 15 is more complex because a 1H reversal and a 2H reversal are switched every frame in comparison with conventional cases. The nature of flickering therefore becomes more difficult to perceive than in conventional cases.

Doubling the frame frequency improves smoothness and continuity in playing video, producing crisp video playback. A disadvantage is that the horizontal period of present embodiment 4, in which charging must be completed to drive the liquid crystal, is halved. This is the cause of insufficient charging which in turn results in the potential of the liquid crystal failing to reach a predetermined value and to produce a grayscale level display. Serious performance degradation ensues. Differences develop over time and across the screen between those regions where polarity is reversed and those where it is not. The differences are visible as, for example, stripes to the human eye. Further, white brightness falls in normally black mode, and black brightness rises in normally white mode.

A cause of the insufficient charging is voltage differences on the source bus lines 12 which develop due to the presence of three types, depending whether the preceding line is of the same or opposite polarity in the 1H reversal frame and in the 2H reversal frame. In this situation, the differences are rendered so that the potentials on the source bus lines 12 are equal, by changing the width of the pulse applied to the gate bus lines 13 for every line, as shown in FIG. 16.

Alternatively, for example, as in embodiment 3, since it is known in advance whether the preceding line is of the same or opposite polarity, the source driver section 5 may be provided with a function which switches the output applied to the source bus lines 12 to switch the output ability.

Another cause of the insufficient charging, which can happen in present embodiment 4, is a difference in voltage of the pixel electrodes 15 after charging, depending on whether the polarity is changed or maintained from the preceding frame, similarly to the case shown in FIG. 7. This is a result of polarity being changed for some pixel electrodes and maintained for the other pixel electrodes between frames. FIG. 7 demonstrates a rising waveform. The same can be said about a falling waveform. The reversal of present embodiment 4 however is based on FIG. 14, thus achieving the polarity conditions shown in FIG. 16.

In the figure, the "L" symbol indicates that the preceding line is of an opposite polarity, "H" indicates that the preceding line is of the same polarity. Here, "H" shows the same charging taking place as at a frame frequency of 60 Hz, which results in sufficiently charging. "L" shows the same charging taking place as a 1H reversal 1-frame reversal at a frame frequency of 120 Hz.

This drive scheme causes changes in brightness over time. However, an alternation typically occurs at double the frame frequency and looks like an average of L and H to the human eye. This is because the difference in brightness between L and H is smaller than differences in brightness between typical moving images and hard to perceive for the human eye.

Brightness is unstable due to variations between liquid crystal panels 7 and other factors, and sufficiently grayscale levels cannot be reproduced, when charging is insufficient. The problem is addressed by mixing colors with the H brightness where a sufficient grayscale level display is achieved. Thus, stability, hence grayscale level reproduction ability, is improved.

With these measures implemented, in comparison with simply raising the frame frequency with conventional technology, grayscale level displays are produced in a more stable manner, and performance degradation where white brightness falls in normally black mode and black brightness rises in normally white mode is addressed, in 120 Hz drive.

Present embodiment 4 has assumed dot reversal. The same effects are achieved with simpler line reversal.

In this manner, in the liquid crystal display 20 of the present embodiment, the base-4 frame counter 2 and the source control signal generator section 3 as interframe polarity control means control the polarity of the liquid crystal in the pixels so as to alternately repeat a horizontal reversal for every two lines and a horizontal reversal for every line for each frame.

Therefore, each pixel switches polarity only once every two frames. However, since the use of double the frame frequency or higher is a condition, the resultant frequency is equal to that in conventional once-per-frame switching. Also, the reversal pattern is complex in comparison with conventional cases because of the alternate repetition of a horizontal reversal for every two lines and a horizontal reversal for every line. The nature of flickering thus becomes difficult to perceive in comparison with conventional cases.

Embodiment 5

Figure 18:
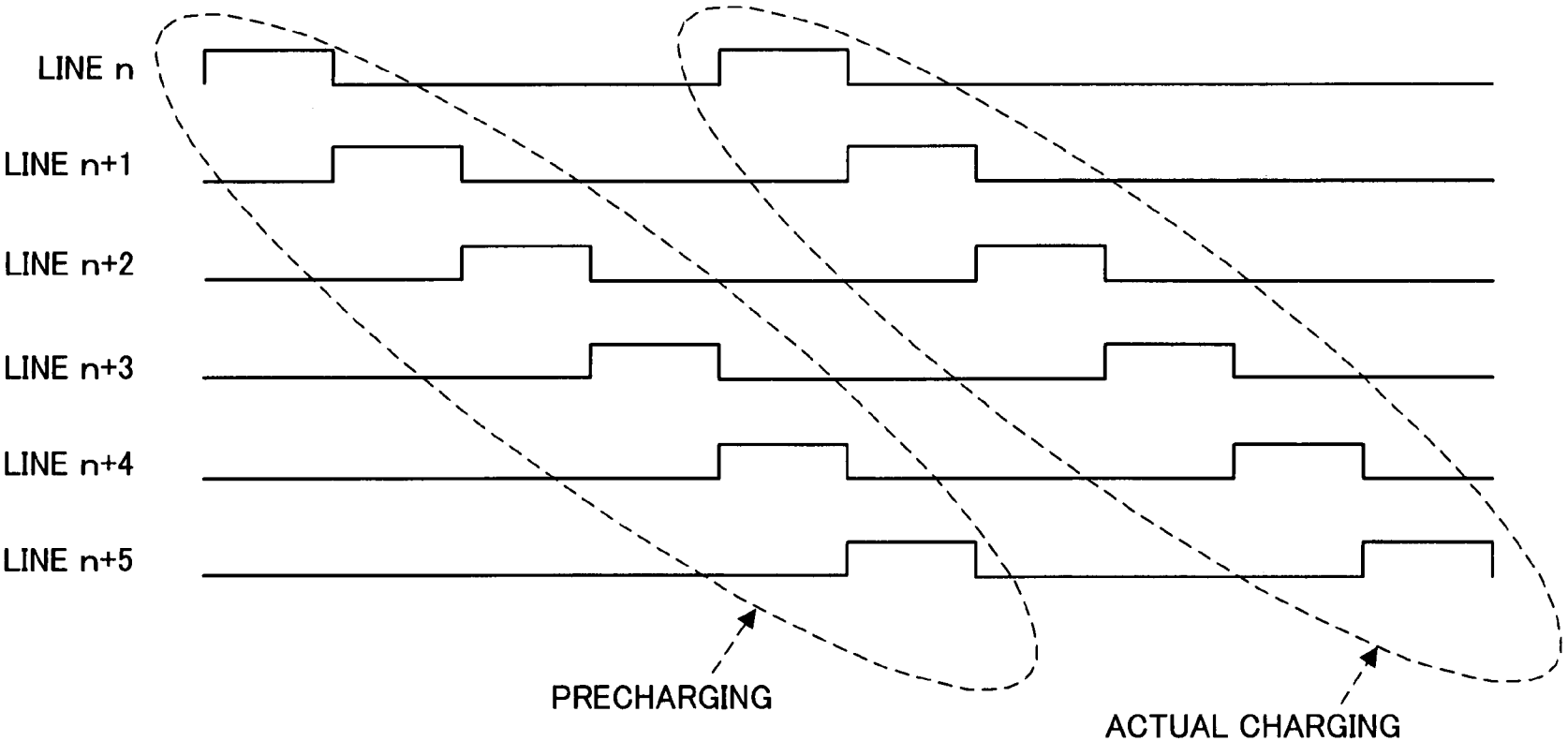
FIG. 18, relating to another embodiment of the liquid crystal display in accordance with the present invention, is a waveform diagram showing timings of the gate voltage in the liquid crystal display.
Figure 19:
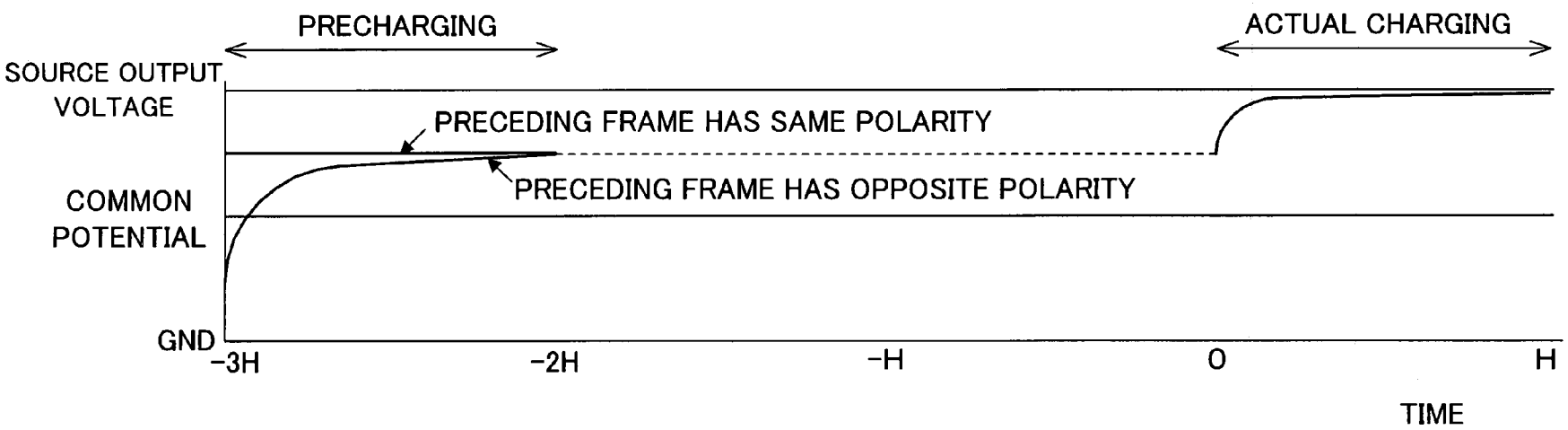
FIG. 19 is a waveform diagram demonstrating how a charging voltage for subpixels in the liquid crystal display changes with the polarity of the preceding frame.

The following will describe another embodiment in accordance with the present invention in reference to FIG. 18 and FIG. 19. The present embodiment shares the arrangement as embodiment 1 through embodiment 4 unless otherwise stated. In addition, for convenience, members of the present embodiment that have the same arrangement and function as members of embodiments 1 to 4, and that are mentioned in that embodiment are indicated by the same reference numerals and description thereof is omitted.

In present embodiment 5, the liquid crystal display 10 again implements the polarity signal reversal between [0] and [1] illustrated in embodiment 1 in reference to FIG. 4 and FIGS. 5(*a*), 5(*b*).

The source driver section 5 applies a voltage to each source bus line 12 in accordance with the control signals. For example, for a common voltage of about 6 V, the positive voltage applied to the source bus line 12 will be set to 6 V to 12 V depending on the image data, whereas the opposite voltage applied will be set to 0 V to 6 V.

In contrast, upon receiving frame edge and line edge information from the data input section 1, the gate control signal generator section 4 transmits control signals, including gate start pulses and a gate clock, which dictates the operation of the gate drive section 6, to the gate drive section 6. Upon receiving a gate start pulse, the gate drive section 6 normally applies HIGH voltage to line 1 and LOW voltage to the other lines. On the next rise of the gate clock, the section 6 applies HIGH voltage only to line 2 and LOW voltage to the other lines. On the succeeding rise of the gate clock, the section 6 applies HIGH voltage only to line 3 and LOW voltage to the other lines. The procedure is repeated by sequentially shifting a line at a time. This voltage application to liquid crystal through a gate pulse signal, which is normally done, will be referred to as actual charging.

In present embodiment 5, as shown in FIG. 18, besides the actual charging, a pulse is applied, for charging, to a line immediately preceding the line to which the same polarity is written. This charging via pulse will be referred to as precharging. Since present embodiment 5 implements a 2H reversal, precharging takes place 4 lines earlier. Similarly, a 1H reversal will result in precharging taking place 2 lines earlier. A 3H reversal will result in precharging taking place 6 lines earlier.

Assume under these circumstances as examples of applied voltages, the use of a gate HIGH voltage of about 32 V to 36 V and a gate LOW voltage of about −9 V to −6 V. Thus, a voltage is applied to the subpixels 11 two lines at a time. The voltage of the source bus lines 12 reverses the voltage applied to the liquid crystal by changing the sign between "+" and "−" in reference to the common potential. This polarity reversal prevents display quality degradation due to polarization of liquid crystal under a constant voltage. However, a brightness difference between the anode and the cathode, if present, is visible as flickering to the human eye. The visibility varies depending on the brightness difference and the frequency of changes.

In the case of present embodiment 5, each pixel switches polarity only once every two frames. However, since the use of double the frame frequency is a condition, the resultant frequency is equal to that in conventional once-per-frame switching. The nature of flickering does not differ between the present embodiment and conventional art.

Doubling the frame frequency improves smoothness and continuity in playing video, producing crisp video playback. A disadvantage is that the horizontal period of present embodiment 5, in which charging must be completed to drive the liquid crystal, is halved. This is the cause of insufficient charging which in turn results in the potential of the liquid crystal failing to reach a predetermined value and to produce a grayscale level display. Serious performance degradation ensues. Differences develop over time and across the screen between those regions where polarity is reversed and those where it is not. The differences are visible as, for example, stripes to the human eye. Further, white brightness falls in normally black mode, and black brightness rises in normally white mode.

A cause of the insufficient charging is a voltage difference between the source bus line 12 which has the same polarity as the preceding line and that which has an opposite polarity to the preceding line as shown in FIG. 6. This is due to the 2H reversal. FIG. 6 demonstrates a rising waveform. The same can be said about a falling waveform.

Another cause of the insufficient charging, which can happen in present embodiment 5, is a difference in voltage of the pixel electrodes after charging. This is a result of polarity being changed for some pixel electrodes and maintained for the other pixel electrodes between frames.

However, in the present embodiment, as shown in FIG. 19, precharging is done prior to actual charging. The precharging reduces a difference due to the polarity condition in the preceding frame, thus reducing difference in charging the pixel electrodes 15 after the termination of actual charging to a very low level.

The reversal of the present embodiment however is based on FIG. 4, similarly to embodiment 1, thus achieving the polarity conditions shown in FIG. 8. Each symbol in the table is made up of two letters, either "L" or "H." The left-hand letter refers to the polarity of the preceding line, with an L indicating an opposite polarity and an H indicating the same polarity. The right-hand letter refers to the polarity in the preceding frame, with an L indicating an opposite polarity and an H indicating the same polarity. Here, "HH" shows the same charging taking place as at a frame frequency of 60 Hz, which results in sufficiently charging. "LL" shows the same charging taking place as a 1H reversal 1-frame reversal at a frame frequency of 120 Hz.

This drive scheme causes changes in brightness over time. However, an alternation typically occurs at double the frame frequency and looks like an average of LL and HH to the human eye. This is because the difference in brightness between LL and HH is smaller than differences in brightness between typical moving images and hard to perceive for the human eye.

In addition, comparing these two effects, the effect of the polarity in the preceding frame is greater. Therefore, present embodiment 5 can reduce the effect to a very low level. Thus, sufficient grayscale level display are produced whereas brightness under insufficient charging is too unstable to reproduce sufficient grayscale levels.

With these measures implemented, in comparison with simply raising the frame frequency with conventional technology, grayscale level displays are produced in a more stable manner, and performance degradation where white brightness falls in normally black mode and black brightness rises in normally white mode is addressed, in 120 Hz drive.

Present embodiment 5 has assumed dot reversal. The same effects are achieved with simpler line reversal.

In this manner, in the liquid crystal display 10 of the present embodiment, a difference in voltage of the pixels after charging develops. This is a result of polarity being changed for some pixel electrodes and maintained for the other pixel electrodes between frames.

Accordingly, in the present embodiment, the gate drive section 6 as gate drive means implements a gate 2 pulse drive to subject the pixels to precharging and actual charging during a horizontal scan period for one line. In addition, the source driver section 5 as source drive means adjusts the source voltage in actual charging in accordance with whether the polarity of the pixel changes or remains unchanged between frames when the gate drive section 6 implements the gate 2 pulse drive.

Therefore, prior to actual charging, precharging is done. Therefore, a difference due to the polarity condition in the preceding frame is small. Therefore, the difference in charging the pixels after the termination of actual charging becomes very small.

Embodiment 6

The following will describe another embodiment in accordance with the present invention in reference to FIG. 20 through FIG. 23. The present embodiment shares the arrangement as embodiment 1 through embodiment 5 unless otherwise stated. In addition, for convenience, members of the present embodiment that have the same arrangement and function as members of embodiments 1 to 5, and that are mentioned in that embodiment are indicated by the same reference numerals and description thereof is omitted.

In the liquid crystal display 10 of present embodiment 6, as shown in FIG. 17 in relation to embodiment 5, a pulse is again applied, for charging, to a line immediately preceding the line to which the same polarity is written, besides the actual charging. In other words, precharging is done.

Since present embodiment 6 implements a 2H reversal, precharging takes place 4 lines earlier. Similarly, a 1H reversal will result in precharging taking place 2 lines earlier which is double the number of reversal lines. A 3H reversal will result in precharging taking place 6 lines earlier which is also double the number of reversal lines.

Thus, similarly to embodiment 5, each pixel switches polarity only once every two frames. However, since the use of double the frame frequency is a condition, the resultant frequency is equal to that in conventional once-per-frame switching. The nature of flickering does not differ between the present embodiment and conventional art.

Doubling the frame frequency improves smoothness and continuity in playing video, producing crisp video playback. A disadvantage is that the horizontal period of present embodiment 6, in which charging must be completed to drive the liquid crystal, is halved. This is the cause of insufficient charging which in turn results in the potential of the liquid crystal failing to reach a predetermined value and to produce a grayscale level display. Serious performance degradation ensues. Differences develop over time and across the screen between those regions where polarity is reversed and those where it is not. The differences are visible as, for example, stripes to the human eye. Further, white brightness falls in normally black mode, and black brightness rises in normally white mode.

A cause of the insufficient charging is a voltage difference between the source bus line 12 which has the same polarity as the preceding line and that which has an opposite polarity to the preceding line as shown in FIG. 6. This is due to the 2H reversal. FIG. 6 demonstrates a rising waveform. The same can be said about a falling waveform.

Another cause of the insufficient charging, which can happen in present embodiment 6, is a difference in voltage of the pixel electrodes after charging. This is a result of polarity being changed for some pixel electrodes and maintained for the other pixel electrodes between frames.

Figure 20:
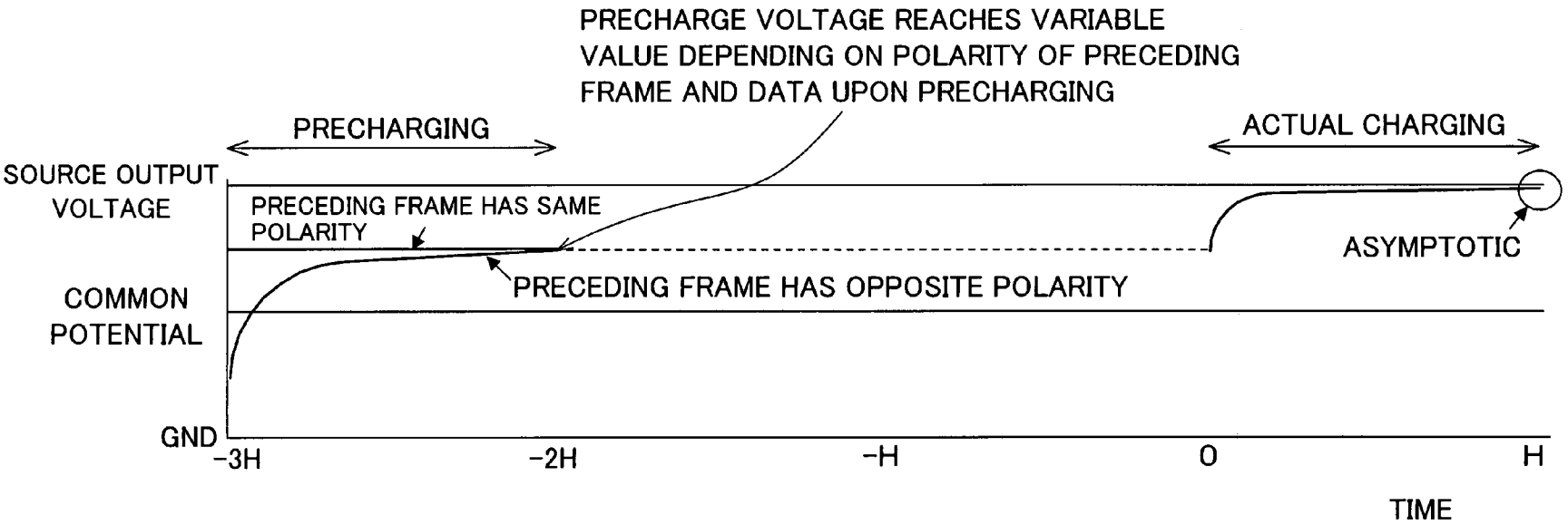
FIG. 20, relating to another embodiment of the liquid crystal display in accordance with the present invention, is a waveform diagram demonstrating how a charging voltage for subpixels in the liquid crystal display changes with the polarity of the preceding frame.
Figure 21:
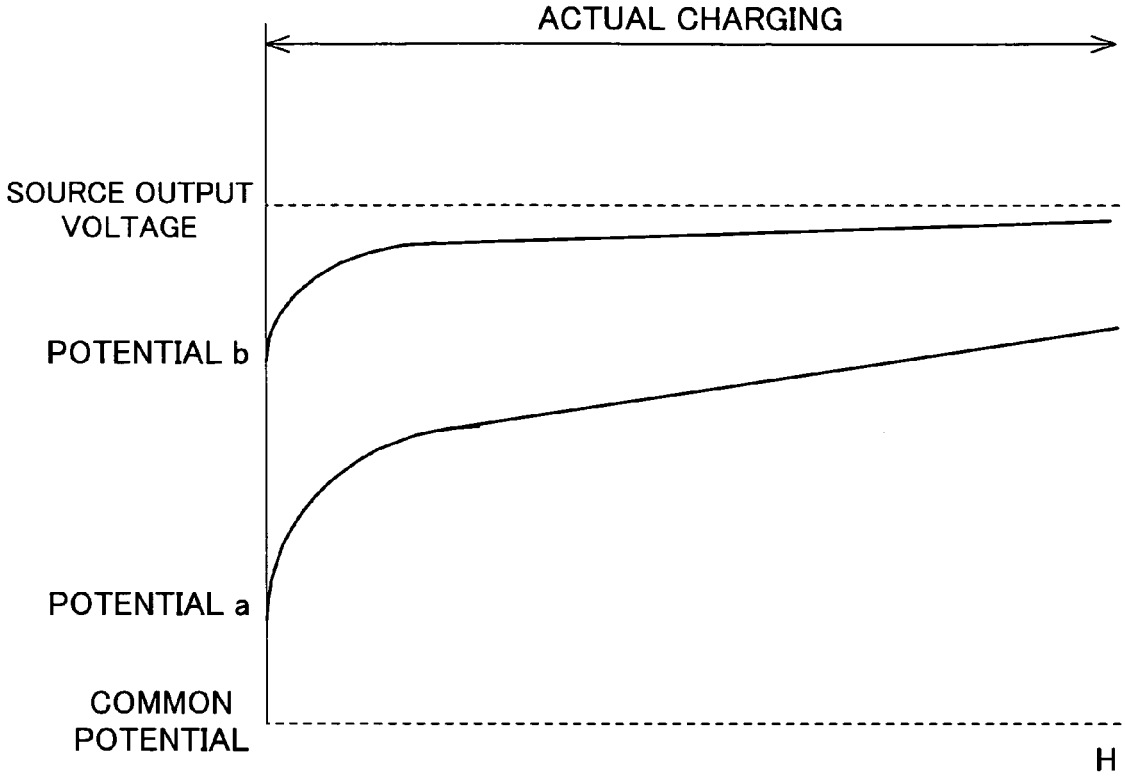
FIG. 21 is a waveform diagram demonstrating how a charging voltage for subpixels in the liquid crystal display changes in actual charging.

However, in present embodiment 6, as shown in FIG. 20, prior to actual charging, precharging is done. Therefore, a difference due to the polarity condition in the preceding frame is small. Therefore, the difference in charging the pixel electrodes 15 after the termination of actual charging becomes very small. However, charging in a precharging interval can accumulate charges by charging in an opposite polarity followed by precharging in the same polarity. However, the voltage applied in a precharging interval is the source application voltage on the line subjected to actual charging at that time (the fourth line as counted back from that line in the case of a 2H reversal). Therefore, as shown in FIG. 21, even when the application voltage in actual charging is identical, the voltage ultimately applied to the pixels differs if the potential at the time of the termination of precharging differs like potential "a" and potential "b."

Figure 22:
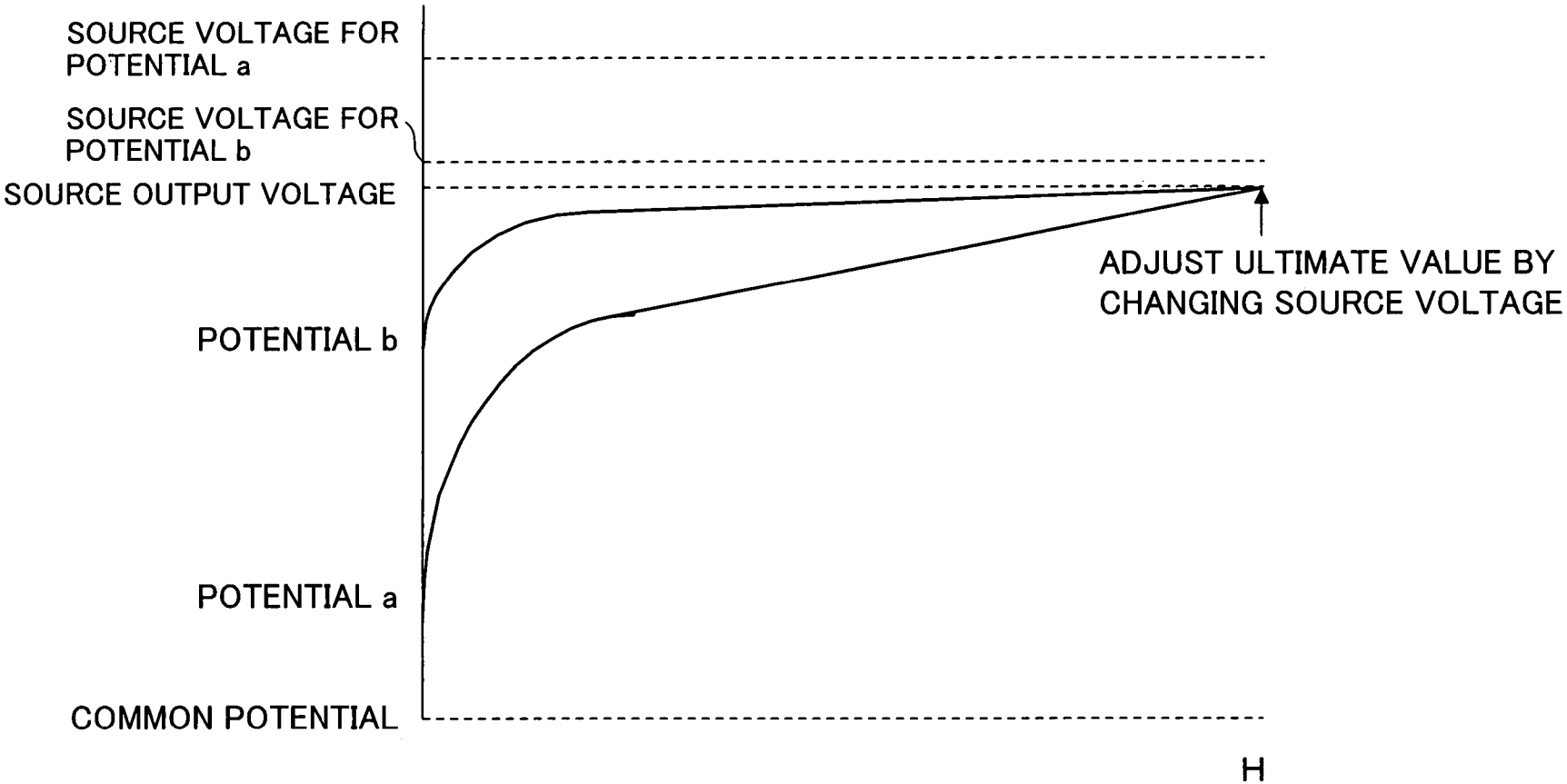
FIG. 22 is a waveform diagram demonstrating how a charging voltage for subpixels in the liquid crystal display changes when the source voltage is corrected.

Accordingly, in present embodiment 6, for example, as shown in FIG. 22, the source potential applied in actual charging is changed by potential "a" and potential "b" at the time of the termination of precharging. Specifically, the potential after precharging terminates is uniquely determined from the relation with the polarity in the preceding frame and the grayscale level of the image data in precharging. Further, from the grayscale level of the image data in actual charging, the table shown in FIG. 23, from which is read the grayscale level of the image data for input to the source driver section 5 corresponding to the voltage to be applied to the source, is prepared and the grayscale level is read. Thus, effects of precharging irregularities can be reduced.

The reversal of present embodiment 6 however is based on FIG. 4 of embodiment 1, thus achieving the polarity conditions shown in FIG. 8 of embodiment 1. Each symbol in the table is made up of two letters, either "L" or "H." The left-hand letter refers to the polarity of the preceding line, with an L indicating an opposite polarity and an H indicating the same polarity. The right-hand letter refers to the polarity in the preceding frame, with an L indicating an opposite polarity and an H indicating the same polarity. Here, "HH" shows the same charging taking place as at a frame frequency of 60 Hz, which results in sufficiently charging. "LL" shows the same charging taking place as a 1H reversal 1-frame reversal at a frame frequency of 120 Hz.

This drive scheme causes changes in brightness over time. However, an alternation typically occurs at double the frame frequency and looks like an average of LL and HH to the human eye. This is because the difference in brightness between LL and HH is smaller than differences in brightness between typical moving images and hard to perceive for the human eye.

In addition, comparing these two effects, the effect of the polarity in the preceding frame is greater. Therefore, present embodiment 6 can reduce the effect to a very low level. Thus, sufficient grayscale level display are produced whereas brightness under insufficient charging is too unstable to reproduce sufficient grayscale levels.

With these measures implemented, in comparison with simply raising the frame frequency with conventional technology, grayscale level displays are produced in a more stable manner, and performance degradation where white brightness falls in normally black mode and black brightness rises in normally white mode is addressed, in 120 Hz drive.

Present embodiment 6 has assumed dot reversal. The same effects are achieved with simpler line reversal.

In this manner, in the liquid crystal display 10 of the present embodiment, there are provided: the gate drive section 6 as gate drive means implementing a gate 2 pulse drive to subject the pixels to precharging and actual charging during a horizontal scan period for one line; and the source driver section 5 as source drive means adjusting the source voltage in actual charging in accordance with the polarity of the pixels in the preceding frame and the potential of the source output in precharging when the gate drive section 6 implements the gate 2 pulse drive.

In other words, in the aforementioned liquid crystal display 10, a difference in voltage of the pixels after charging develops. This is a result of polarity being changed for some pixel electrodes and maintained for the other pixel electrodes between frames.

However, according to the present embodiment, the source driver section 5 adjusts the source voltage in actual charging in accordance with the polarity of the pixels in the preceding frame and the potential of the source output in precharging when the gate drive section 6 implements the gate 2 pulse drive.

Therefore, since the source voltage in actual charging is adjusted based on the polarity of the pixels in the preceding frame and the potential of the source output in precharging, differences in charged voltage between pixels can be reliably prevented which develop due to some pixels changing polarity between frames and the others remaining unchanged in polarity.

Embodiment 7

Figure 24:
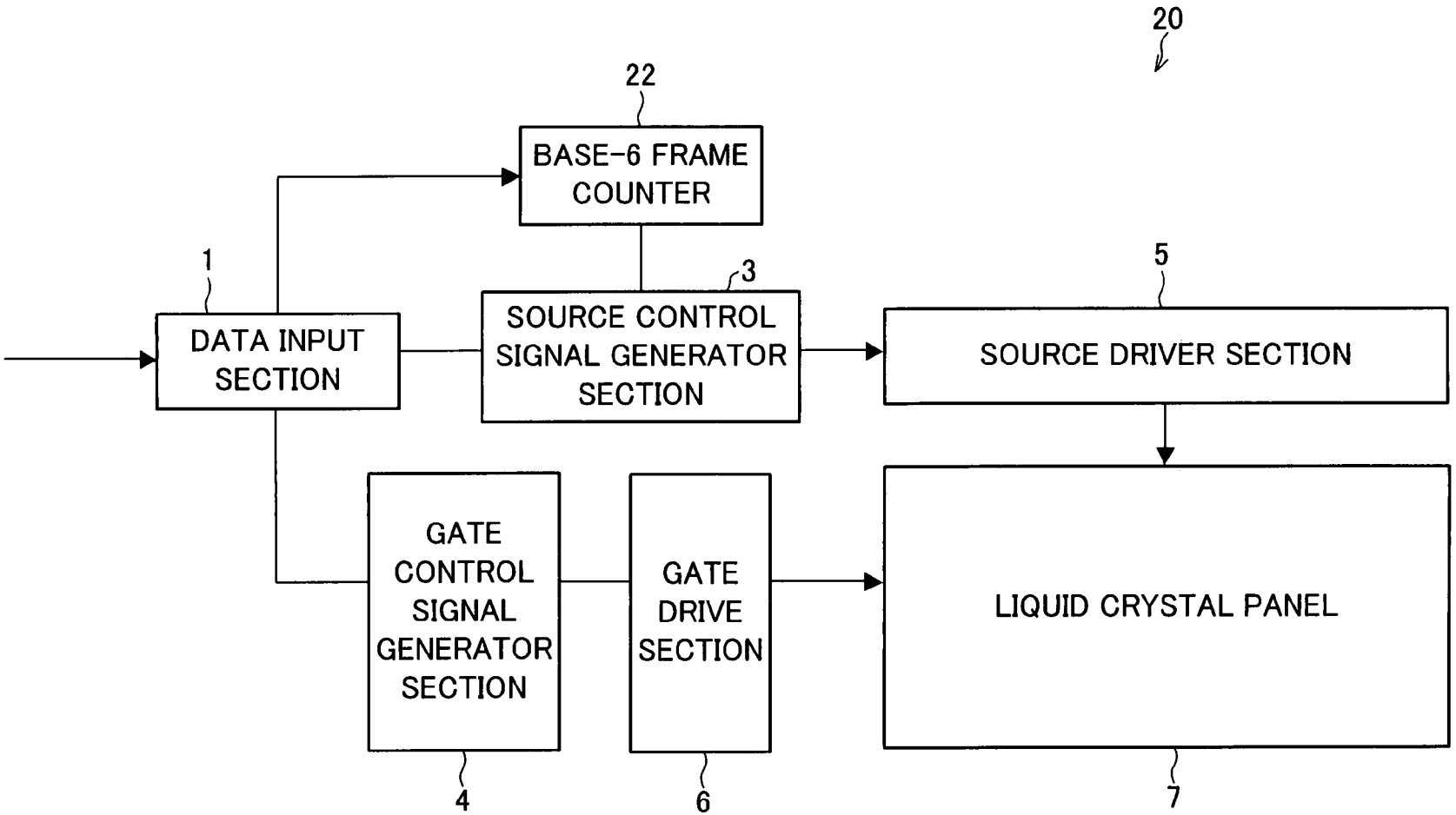
FIG. 24, relating to another embodiment of the liquid crystal display in accordance with the present invention, is a block diagram illustrating the arrangement of a liquid crystal display.

The following will describe another embodiment in accordance with the present invention in reference to FIG. 24 through FIG. 26. The present embodiment shares the arrangement as embodiment 1 through embodiment 6 unless otherwise stated. In addition, for convenience, members of the present embodiment that have the same arrangement and function as members of embodiments 1 to 6, and that are mentioned in that embodiment are indicated by the same reference numerals and description thereof is omitted.

In embodiments 1 to 3, 5, and 6, based on the reversal of the polarity signal [0], [1] discussed in embodiment 1 in reference to FIG. 4 and FIGS. 5(*a*), 5(*b*), the polarity of the liquid crystal in the pixels for each frame is repeatedly subjected alternately to a horizontal reversal for every two lines and to a horizontal reversal for every two lines after shifting the polarity of the lines in the preceding frame by one line.

However, an alternative reversal method may be adopted. For example, it is preferable if for example, a larger frame counter, such as a base-6 frame counter, is used in place of the aforementioned base-4 frame counter 2 when the reversal cycle becomes longer.

A reason for so dosing is possibility of cases where the frame frequency may be increased to three times the frame frequency of input signals or greater, although embodiments 1 to 6 assumed frame frequencies of 100 Hz through 120 Hz which is double the frame frequency of 50 Hz through 60 Hz of input signals.

From this, the liquid crystal display 20 as the display of present embodiment 7 contains, as shown in FIG. 24, a data input section 1, a base-6 frame counter 22, a source control signal generator section 3, a gate control signal generator section 4, a source driver section 5, a gate drive section 6, a liquid crystal panel 7, and a backlight (not shown).

The base-6 frame counter 22 is a base-6 counter for frame edges. The counter increments: "0, 1, 2, 3, 4, 5, 0, 1 . . . " The count is sent to the source control signal generator section 3.

In addition, in the present embodiment, the polarity signal is switched between [0] and [1] as shown in FIG. 25.

In other words, as shown in FIG. 25, the polarity of the liquid crystal in the pixels for each frame is repeatedly subjected alternately to a horizontal reversal for every three lines and to a horizontal reversal for every three lines after shifting the polarity of the lines in the preceding frame by one line. The polarity signal, either [0] or [1], is fed from the source control signal generator section 3 to the source driver section 5.

Thus, when the frame frequency of input signals is as high as three times, as in present embodiment 7, with the arrangement using the table in FIG. 25, the polarity reversal in each frame, as well as the processing as in embodiments 1 to 6, is carried out to address insufficient charging and achieve higher display quality.

This is not necessarily limited to the reversal method, but can be generalized as follows. The polarity of the liquid crystal in the pixels for each frame is repeatedly subjected alternately to a horizontal reversal for every m lines (m is 2 or a greater positive integer) and to a horizontal reversal for every m lines after shifting the polarity of the lines in the preceding frame by n lines (n is a positive integer equal to a half or less of m).

For example, FIG. 25 shows a horizontal reversal for every three lines for each frame. Alternatively, a reversal may take place every four, five, . . . lines. Further, FIG. 25 shows the polarity of the lines in the preceding frame being shifted by one line for each frame. Alternatively, the polarity may be shifted by two, three, . . . lines. These make it possible to address insufficient charging and achieve higher display quality.

This line of concept may be enhanced. For example, as shown in FIG. 26, a horizontal reversal for every two lines and a horizontal reversal for every line may be mixed for each frame. In other words, reversals may be mixed.

Such reversals, together with the process of embodiments 1 to 6, make it possible to address insufficient charging and achieve higher display quality.

This means that the reversal method for each frame is as arbitrary as possible when the frame frequency of input signals is increased. When that is the event, the reversal method for each frame is not necessarily limited to this, but may be arbitrary in multiple frames.

In other words, using the base-6 frame counter 22, a reversal arbitrarily takes place between frames and lines with six frames as a unit. Therefore, the reversal method in the preceding six frames is repeated in the succeeding six frames. In addition, for example, the base-4 frame counter 2 can carry out an arbitrary reversal between frames and lines with four frames as a unit.

Further expanding the concept, for example, a random reversal between frames and lines is possible using a base-2 frame counter, a base-3 frame counter, a base-5 frame counter, a base-7 frame counter, . . . , with two frames, three frames, five frames, seven frames, . . . as a unit.

In this manner, the liquid crystal display 20 of the present embodiment drives the pixels by an active matrix drive at 100 Hz or higher frame frequencies. There is provided the base-6 frame counter 22 and the source driver section 5 as interframe polarity control means controlling the polarity of the liquid crystal in the pixels for each frame so as to alternately repeat a horizontal reversal for every three lines and a horizontal reversal for every three lines after shifting the polarity of the lines in the preceding frame by one line.

Therefore, it is possible to provide a liquid crystal display capable of addressing insufficient charging and achieving higher display quality even at high frame frequencies.

In addition, the liquid crystal display 20 of the present embodiment drives the pixels by an active matrix drive at 100 Hz or higher frame frequencies. There is provided the base-6 frame counter 22 as polarity control means subjecting the polarity of the liquid crystal in the pixels to a horizontal reversal once for a certain number of lines for each frame.

In other words, when the conventional frame frequency of 50 Hz through 60 Hz is, for example, doubled to 100 Hz through 120 Hz to produce smooth moving images, if the polarity of the pixels was reversed every frame as in conventional art, the charge time would be halved, resulting in insufficient charging.

However, according to the present embodiment, the base-6 frame counter 22 subjects the polarity of the liquid crystal in the pixels to a horizontal reversal once for a certain number of lines for each frame.

Therefore, for example, when the frame frequency is double the conventional frame frequency, by implementing a horizontal reversal once every two lines, as a result, the same display quality as at the conventional frame frequency of 50 Hz through 60 Hz is achieved.

In addition, in the liquid crystal display 20 of the present embodiment, the base-6 frame counter 22 implements a horizontal reversal while different types of horizontal reversals for a certain number of lines are mixed for each frame. Therefore, the reversal pattern is complex in comparison with conventional cases, and the nature of flickering becomes difficult to perceive in comparison with conventional cases.

In addition, in the liquid crystal displays 10, 20 of present embodiment 1 through embodiment 7, there are provided the base-4 frame counter 2 or base-6 frame counter 22 and the source driver section 5 as interframe polarity control means controlling to alternately repeat, for each frame, a first reversal pattern where the polarity of the liquid crystal in the pixels is subjected to a horizontal reversal once every m lines (m is 2 or a greater positive integer) and a second reversal pattern where the polarity reversal of the lines in the first reversal pattern is shifted by n lines (n is a positive integer equal to a half or less of m).

In other words, in the liquid crystal display driving the pixels by an active matrix drive, there is provided interframe polarity control means controlling the polarity of the liquid crystal in the pixels so as to alternately repeat, in each frame, a horizontal reversal once every m lines (m is 2 or a greater positive integer) and a horizontal reversal once every m lines after shifting the polarity of the lines in the preceding frame by n lines (n is a positive integer equal to a half or less of m).

Therefore, it is possible to provide a liquid crystal display capable of addressing insufficient charging and achieving higher display quality even at high frame frequencies.

The liquid crystal display 20 of the present embodiment can drive the pixels by an active matrix drive at a popular frame frequency of 50 Hz or higher. In other words, a conventional technique exists whereby the grayscale level r and the grayscale level s are alternately displayed between frames to produce an intermediate grayscale level as part of pseudo-grayscale level technology (whereby the number of apparent grayscale levels is increased by, for example, simulating 8-bit color reproduction on hardware capable of 6-bit color reproduction). With this technique, grayscale levels can be averaged at ordinary frame frequencies of 50 Hz through 60 Hz. Thus, the technique of the present embodiment can be implemented also at 50 Hz through 60 Hz. Note that the pseudo-grayscale level technology still causes some display quality degradation. When display quality is the priority, it is desirable if the embodiment is implemented at 100 Hz or higher frame frequencies which is double the conventional frame frequencies.

In addition, in the liquid crystal displays 10, 20 of present embodiment 1 through embodiment 7, there is provided the base-4 frame counter 2 or base-6 frame counter 22 as multiple-frame unit control means subjecting the polarity of the liquid crystal in the pixels to a reversal with multiple frames as a unit.

Therefore, the multiple-frame unit control means is provided; therefore, the polarity of the liquid crystal in the pixels can be reversed with multiple frames as a unit. A different reversal can be carried out from the conventional reversal which takes place in every frame.

Therefore, it is possible to provide a liquid crystal display capable of addressing insufficient charging and achieving higher display quality even at high frame frequencies.

Embodiment 8

Figure 27:
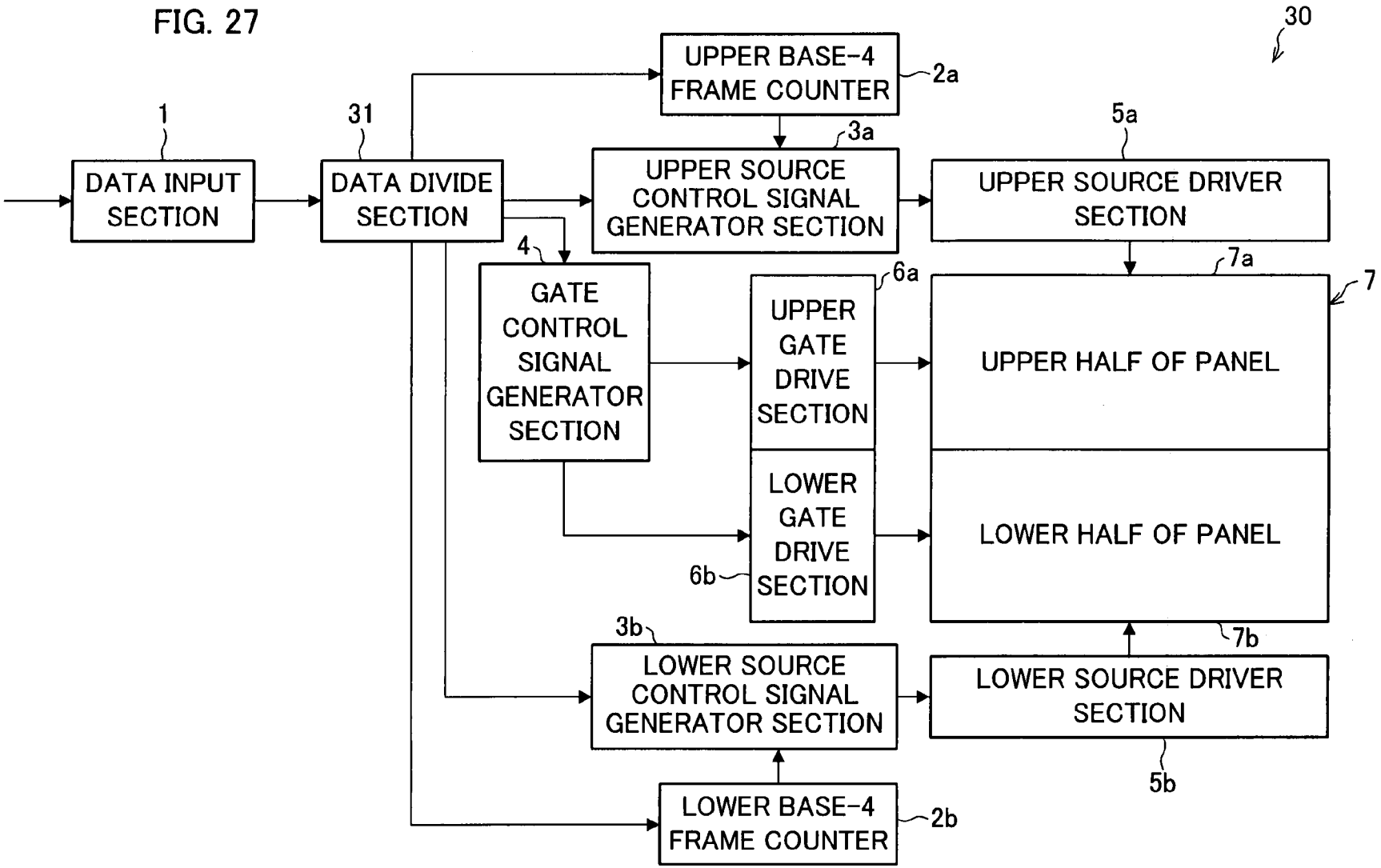
FIG. 27, relating to another embodiment of the liquid crystal display in accordance with the present invention, is a block diagram illustrating the arrangement of a liquid crystal display.

The following will describe another embodiment in accordance with the present invention in reference to FIG. 27. The present embodiment shares the arrangement as embodiment 1 through embodiment 7 unless otherwise stated. In addition, for convenience, members of the present embodiment that have the same arrangement and function as members of embodiments 1 to 7, and that are mentioned in that embodiment are indicated by the same reference numerals and description thereof is omitted. In the present embodiment, as shown in FIG. 27, the source drive section 5 as source drive means is divided into an upper source drive section 5*a* and a lower source drive section 5*b*, both being provided on the liquid crystal panel 7 which is also divided into an upper panel 7*a* and a lower panel 7*b* which are driven by the respective upper and lower drive sections 5*a* and 5*b*.

This is a method addressing insufficient gate ON times in the production of a display by dividing the screen into upper and lower halves. In a liquid crystal display 30 as such a display device, as shown in the figure, the upper source drive section 5*a* and the lower source drive section 5*b* are placed on the liquid crystal panel 7, and the gate drive section 6 as gate drive means is also divided into an upper gate drive section 6*a* and a lower gate drive section 6*b*. The upper panel 7*a* is driven by the upper gate drive section 6*a* and the upper source drive section 5*a*. The lower panel 7*b* is driven by the lower gate drive section 6*b* and the lower source drive section 5*b*. This drive scheme can simultaneously writes the upper gate drive section 6*a* and the lower gate drive section 6*b*. Each H time is thus doubled. the gate ON time also increases with this extended time.

This technique enables the liquid crystal to operate at increased frame frequencies when the technique is used in combination with a drive method of alternately repeating in each frame the first reversal pattern where the polarity of the liquid crystal in the pixels is subjected to a horizontal reversal once every m lines (m is 2 or a greater positive integer) and the second reversal pattern where the polarity reversal of the lines in the first reversal pattern is shifted by n lines (n is a positive integer equal to a half or less of m).

Going into more detail, the liquid crystal display 30, as shown in the figure, contains a data input section 1, a data divide section 31, an upper base-4 frame counter 2*a*, a lower base-4 frame counter 2*b*, an upper source control signal generator section 3*a*, a lower source control signal generator section 3*b*, a gate control signal generator section 4, an upper source drive section 5*a*, a lower source drive section 5*b*, an upper gate drive section 6*a*, a lower gate drive section 6*b*, an upper panel 7*a*, a lower panel 7*b*, and a backlight (not shown).

The data input section 1 receives a signal input from an external device (not shown), detects a frame edge and a line edge of the input signal from synchronization signals, and feeds a signal representing that edge detection to the data divide section 31, the upper base-4 frame counter 2*a*, the lower base-4 frame counter 2*b*, the upper source control signal generator section 3*a*, the lower source control signal generator section 3*b*, and the gate control signal generator section 4.

The data divide section 31 divides data for the upper half of the liquid crystal panel 7 and for the lower half of the liquid crystal panel 7 for transmission to the upper source control signal generator section 3*a*, the lower source control signal generator section 3*b* respectively. The upper base-4 frame counter 2*a* and the lower base-4 frame counter 2*b* counts the synchronization signals for the frames and sends the counter reading to the upper source control signal generator section 3*a* and the lower source control signal generator section 3*b*. The upper source control signal generator section 3*a* and the lower source control signal generator section 3*b* generate drive signals from the synchronization signal, data, and base-4 counter reading for a transmission to the upper source drive section 5*a* and the lower source drive section 5*b*. The gate control signal generator section 4 generates drive signals from the synchronization signal for a transmission to the upper gate drive section 6*a* and the lower gate drive section 6*b*. The upper source drive section 5*a* and the lower source drive section 5*b* generate a voltage which will be applied to the source bus lines 12 on the liquid crystal panel 7. The upper gate drive section 6*a* and the lower gate drive section 6*b* generate a voltage which will be applied to the gate bus lines 13 on the liquid crystal panel 7. The upper panel 7*a* and the lower panel 7*b* are completely divided for the upper and lower halves respectively so that they can independently operate.

In this manner, in the liquid crystal display 30 of the present embodiment, the liquid crystal panel 7 is divided into two parts, one for a first screen and the other for a second screen. Thus, the liquid crystal display 30 provides a hardware means to address charge insufficiency for higher display quality even at high frame frequencies. This reduces the charging time to a quarter of the original when digital high vision involving twice the number of lines specified in conventional broadcast standards is displayed at double the frame frequency, which can be dealt with the technique of the present embodiment.

Embodiment 9

The following will describe another embodiment in accordance with the present invention in reference to FIG. 28 to FIG. 31. The present embodiment shares the arrangement as embodiment 1 through embodiment 8 unless otherwise stated. In addition, for convenience, members of the present embodiment that have the same arrangement and function as members of embodiments 1 to 8, and that are mentioned in that embodiment are indicated by the same reference numerals and description thereof is omitted.

The liquid crystal display of the present embodiment improves efficiency in overshoot drive by means of built-in functions of frame frequency doubling for an input signal and interframe interpolation.

In other words, the liquid crystal display of the present embodiment is aimed at high frame frequency operation. Typical TV and monitor signals have frame frequencies from about 50 Hz to as high as about 85 Hz. The use of frame frequencies beyond 100 Hz in the present embodiment is to achieve smooth a TV display.

To this end, in the present embodiment, input signals are subjected to interpolation, and their frame frequencies are raised, so that the interpolated signals are inserted between the input signals.

Figure 28:
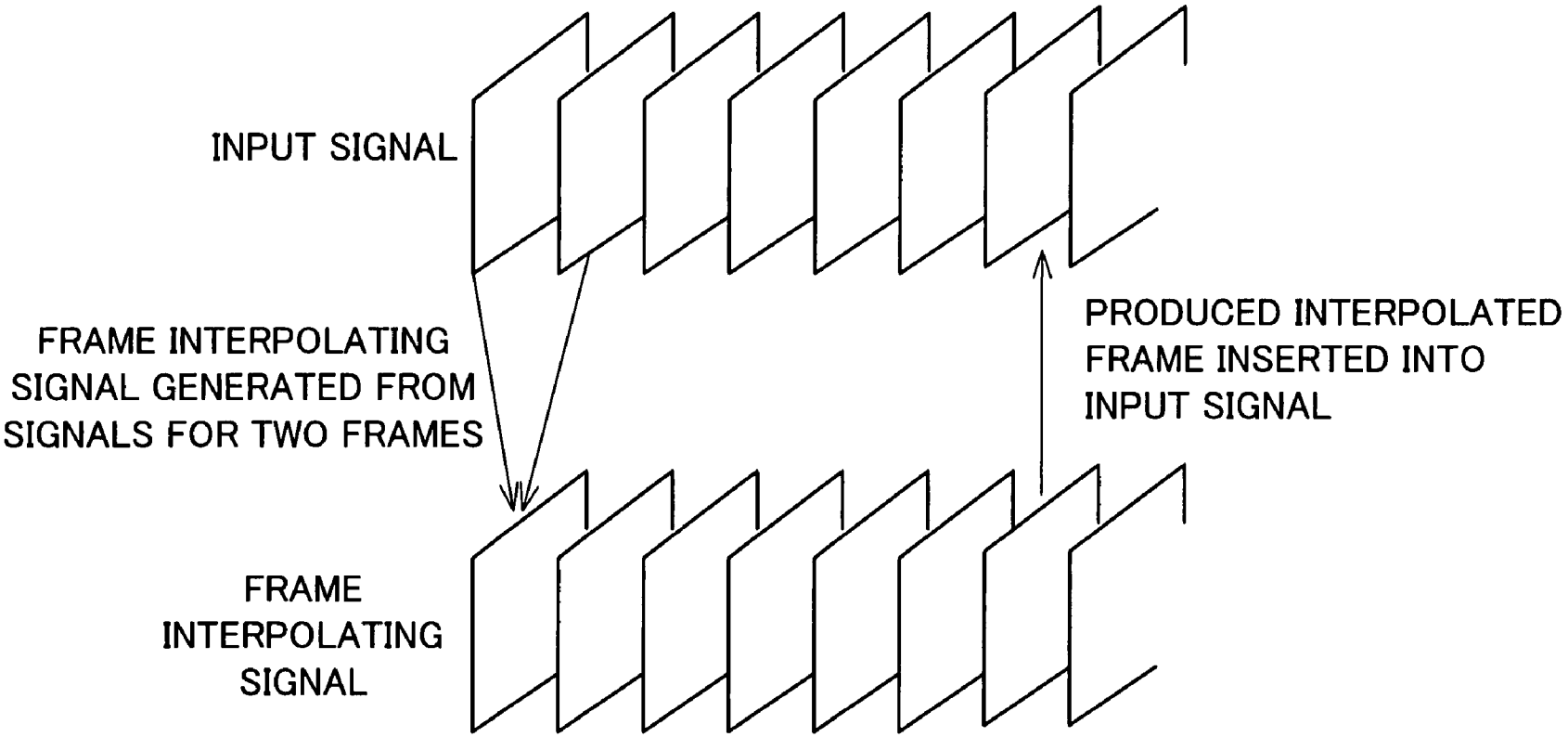
FIG. 28, relating to another embodiment of the liquid crystal display in accordance with the present invention, is a conceptual drawing illustrating a frame interpolation method.

Specifically, to double the frame frequency, as shown in FIG. 28, upon the inputs of frames as input signals, a signal for a frame between two successive frames is generated to interpolate the signals for the two frames. Thereafter, the interpolated frame is inserted between the signals for two successive frames. Thus, the frame count doubles. Therefore, these doubled frames are processed at double the frame frequency. This process is normally carried out immediately before the liquid crystal display.

The present embodiment uses this technique to further improve the display quality of the liquid crystal. Incidentally, the adoption of this technique entails the slow response speed of the liquid crystal display, a defect of such a display, becoming an issue.

The issue can be addressed by overshoot drive (also termed overdrive).

According to overshoot drive, when the liquid crystal's response is too slow compared to interframe grayscale level changes, the response speed is increased by applying greater grayscale level changes than actual to the liquid crystal.

Specifically, for example, as shown in FIG. 29, to change the grayscale level from 0 to 32, a signal is sent which causes a change to grayscale level 78 instead of grayscale level 32.

In contrast, in this example, FIG. 30 shows in detail the part where the preceding frame is at grayscale level 0 and the current frame changes from grayscale level 224 to grayscale level 225. As can be seen from the figure, for example, for current frames of grayscale levels 224 to 227, a signal is sent which causes a change to grayscale level 248 as overshoot drive. Similarly, for current frames of grayscale levels 228 to 231, a signal is sent which causes a change to grayscale level 249 as overshoot drive. For current frames of lower grayscale levels, the same overshoot drive grayscale level signal is sent for every four grayscale levels.

To put it differently, this means that sending a signal which causes a change to, for example, grayscale level 248 as overshoot drive results only in one of 224 to 227 grayscale level representations as the current frame grayscale level. Therefore, there actually are 32 grayscale levels from 224 grayscale levels to 255 grayscale levels, whereas there are only 8 grayscale levels that can be represented. Representation capability is degraded by that amount.

Accordingly, before double speed drive, overshoot drive is done in the case of a change to an interpolated frame, whereas no overshoot is done in the case of a change from an interpolated frame to an input signal screen. Thus, the grayscale level is not damaged to an image formed from an input signal. A grayscale level feel is not lost with respect to input signals.

In other words, since the human eye is sensitive to brightness change points, it reacts sensitively if a grayscale level change point disappears. For example, in grayscale display, etc., the viewer will feel unpleasant if the grayscale level change disappears. Conversely, the human eye is not sensitive to absolute brightness. Therefore, it is important for a difference in brightness to exist between different grayscale levels. There is no problem with respect to interpolated frames even if grayscale levels are somewhat off correct values, because they are data generated by interpolation. Frames are interpolated for additional frames for insertion for smooth movement displays, because the human eye is precise for outlines.

An afterimage feel due to a drop in response speed can be reduced by overshooting and thus improving the response speed by that amount.

Specifically, VA (Vertical Alignment) mode liquid crystal is slowest at 100 ms (approximately equivalent to a 5 frame period at 60 Hz) around the change of a voltage applied to the liquid crystal from 0 V to 1 V. An equivalent to the about 5 frame period can be accommodated in a 1 frame period by overshooting because it is a change in the grayscale level. Since in the present embodiment, overshoot is carried out when changing to an interpolated frame, a response time is accommodated in each frame of an original input signal. As a result, an afterimage feel is reduced.

Figure 31:
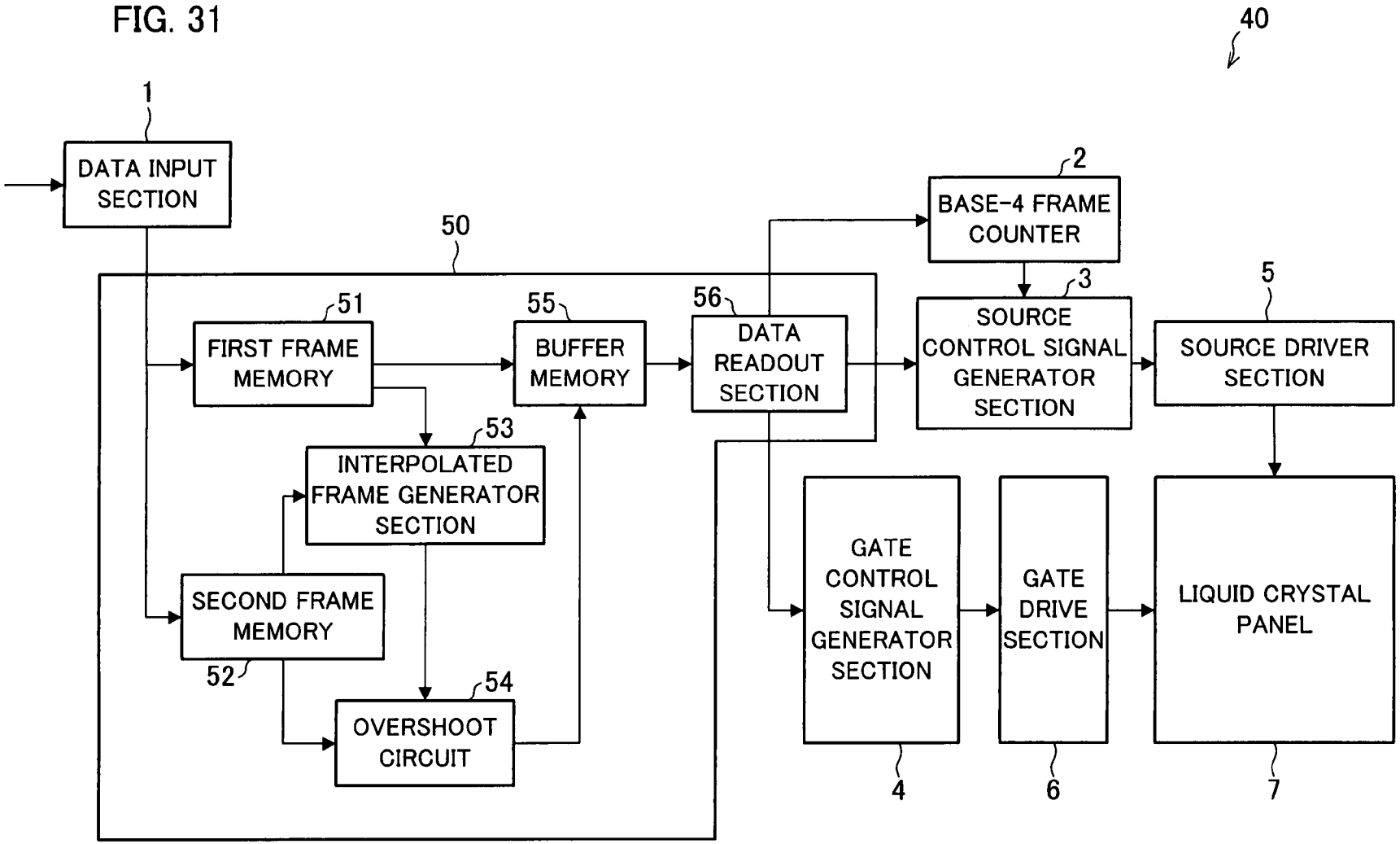
FIG. 31, relating to another embodiment of the liquid crystal display in accordance with the present invention, is a conceptual drawing illustrating a frame interpolation method.

Going into more detail, a liquid crystal display 40 as the display of the present embodiment, as shown in FIG. 31, contains an interpolate/overshoot section 50 between the data input section 1 and the base-4 frame counter 2, source control signal generator section 3, and gate control signal generator section 4, all in the liquid crystal display 10 detailed in embodiment 1.

The interpolate/overshoot section 50 contains a first frame memory 51, a second frame memory 52, an interpolated frame generator section 53 as frame interpolate means, an overshoot circuit 54 as overshoot drive means, a buffer memory 55, and a data readout section 56. The data input section 1 receives external signals and stores incoming data to the first frame memory 51 and the second frame memory 52.

The first frame memory 51 outputs data for the preceding frame. The second frame memory 52 outputs data for the frame immediately before the preceding frame. The interpolated frame generator section 53 generates data halfway between the preceding frame and the frame immediately before that preceding frame (one-and-half frames ago) from data for the preceding frame and data for the frame immediately before that preceding frame.

The overshoot circuit 54 calculates overshooting from the data for the frame immediately before the preceding frame and the data one-and-half frames ago (interpolated) to correct data one-and-half frames ago.

Since the signal for the preceding frame and the signal one-and-half frames ago are simultaneously generated, the buffer memory 55 temporarily stores data in memory, thereby first outputting the signal one-and-half frames ago and then outputting the signal for the preceding frame.

The data readout section 56 reads data from the buffer memory 55, reattach a synchronization signal for output. The section 56 feeds data only to the source control signal generator section 3, and sends the synchronization signal to the source control signal generator section, the base-4 frame counter 2, and the gate control signal generator section 4. Here, since the section 56 processes at double the 2 frame frequency of the input signal, the control signal needs be remade.

Otherwise, the arrangement is similar the liquid crystal display 10 of embodiment 1. Detailed description is omitted.

Here, In the present embodiment, the interpolate/overshoot section 50 has two mechanisms: interpolation and overshooting. Alternatively, either one of mechanisms will do. In other words, for example, whatever the overshooting, an interpolated frame is produced inside the liquid crystal display for use to improve liquid crystal display quality.

In addition, the foregoing description assumed operation at double the frame frequency as an example. Alternatively, for example, similar operation is possible at 1.5 times the frequency, in which case, an image is produced first from an input signal, then by interpolation, and again by interpolation, and the process is repeated to produce a display.

In this case, similar processing is possible by again performing no overshoot when changing to an input signal frame and performing overshoot when changing to an interpolated image.

In this manner, in the liquid crystal display 40 of the present embodiment, the interpolated frame generator section 53 inserts an interpolated frame between frames. Therefore, since changes in movements in images are displayed in detail for the amount of the interpolated frames with respect to video and other input signals, the display appears smooth.

In addition, the frame frequency of the input signal can be multiplied by k in the data readout section 56 which functions as clock means. Therefore, any number of interpolated frames may be inserted between frames.

In addition, in the liquid crystal display 40 of the present embodiment, the overshoot circuit 54 applies a voltage corresponding to a higher grayscale level than the grayscale level represented by the input signal to pixels. Therefore, even at reduced frame frequencies, pixels are sufficiently charged.

As in the foregoing, a liquid crystal display of the present invention includes: a liquid crystal display screen composed of pixels arranged in a matrix; gate drive means outputting a gate pulse to gate lines connected to gates of thin film transistors in the pixels; and source drive means outputting a source voltage to source lines connected to sources of the thin film transistors in the pixels.

According to the invention, insufficient charging is addressed for higher display quality even at high frame frequencies, with liquid crystal displays typically including a liquid crystal display screen, gate drive means, and source drive means.

In addition, in a liquid crystal display of the present invention, the liquid crystal display screen is divided into two: a first screen and a second screen; the gate drive means is divided into two: first gate drive means outputting a gate pulse to gate lines connected to gates of thin film transistors in pixels in the first screen and second gate drive means outputting a gate pulse to gate lines connected to gates of thin film transistors in pixels in the second screen; and the source drive means is divided into two: first source drive means outputting a source voltage to source lines connected to sources of the thin film transistors in the pixels in the first screen and second source drive means outputting a source voltage to source lines connected to sources of the thin film transistors in the pixels in the second screen.

In other words, at high frame frequencies, the voltage charge period to the pixels is short, possibly resulting in failure to apply a desired voltage to all the pixels in one frame period.

Accordingly, in the present invention, the liquid crystal display screen is divided into two: the first screen and the second screen. Thus, a liquid crystal display is provided which addresses insufficient charging by means of hardware for higher display quality even at high frame frequencies.

In addition, when a liquid crystal display of the present invention implements a horizontal reversal once every m lines, the gate drive means regulates a gate pulse width on each of the m lines during a horizontal scan period which covers m lines.

In addition, in a liquid crystal display of the present invention, the gate drive means regulates the gate pulse width on each line in accordance with the polarity of pixels in the preceding line.

In other words, insufficient charging may occur depending on whether the polarity of pixels in the preceding line is of an identical or opposite polarity, which appears like stripes to the human eye.

Accordingly, in the present invention, the gate drive means regulates the gate pulse width on each of the m lines during a horizontal scan period which covers m lines when implementing a horizontal reversal once every m lines. Thus, even when the gate pulse width is increased/decreased in any of the lines, no problem occurs as a drive scheme provided that the widths as a whole make up a horizontal scan period covering m lines. In other words, it would suffice to increase the gate pulse width when charging is insufficient due to the relationship with the polarity in the preceding line and decrease, by the time of the width, the time for the gate pulse width where charge is sufficient due to the relationship with the polarity in the preceding line.

Thus, there can be provided the liquid crystal display capable of addressing insufficient charging and achieving higher display quality.

In addition, in a liquid crystal display of the present invention, the source drive means regulates a source voltage output when implementing a horizontal reversal once every m lines.

In other words, when implementing a horizontal reversal once every m lines, charging may in some cases be insufficient due to the relationship with the polarity in the preceding line.

However, according to the present invention, the source drive means regulates the source voltage output when implementing a horizontal reversal once every m lines. Specifically, when charging is insufficient due to the relationship with the polarity in the preceding line, since charging is done quickly by raising the source potential, the insufficient charging is solved.

In addition, a liquid crystal display of the present invention, the source drive means includes source voltage switch means regulating the source voltage output by switching between predetermined two source voltages in accordance with the polarity of pixels in the preceding line.

According to the invention, source voltage switch means is provided which regulates the source voltage output by switching between predetermined two source voltages in accordance with the polarity of pixels in the preceding line. Two source voltages are specified, one for insufficient charging and another for sufficient charging, between which switching can be made. Therefore, the source voltage output can be readily regulated.

In addition, in the liquid crystal display of the present invention, in the liquid crystal display driving pixels by active matrix drive at a frame frequency of 100 Hz or higher, there is provided interframe polarity control means controlling the polarity of the liquid crystal in the pixels so as to alternately repeat, for each frame, a horizontal reversal for every two lines and a horizontal reversal for every line.

In addition, a method of driving a liquid crystal display of the present invention, to solve the problems, in a method of driving a liquid crystal display driving pixels by active matrix drive at a frame frequency of 100 Hz or higher, a horizontal reversal for every two lines and a horizontal reversal for every line are alternately repeated for each frame with respect to the polarity of the liquid crystal in the pixels.

According to the invention, the interframe polarity control means controls the polarity of the liquid crystal in the pixels so as to alternately repeat, for each frame, a horizontal reversal for every two lines and a horizontal reversal for every line.

Therefore, each pixel switches polarity only once every two frames. However, since the use of double the frame frequency or higher is a condition, the resultant frequency is equal to that in conventional once-per-frame switching. Also, the reversal pattern is complex in comparison with conventional cases because of the alternate repetition of a horizontal reversal for every two lines and a horizontal reversal for every line. The nature of flickering thus becomes difficult to perceive in comparison with conventional cases.

In addition, in a liquid crystal display of the present invention, the gate drive means implements a gate 2 pulse drive to subject the pixels to precharging and actual charging during a horizontal scan period for one line. When the gate drive means implements the gate 2 pulse drive, the source drive means adjusts the source voltage in actual charging in accordance with whether the pixels have identical or opposite polarities between frames.

In other words, in the aforementioned invention, the polarity may or may not change between frames, resulting in different potential charged to the pixels.

However, according to the present invention, the gate drive means implements a gate 2 pulse drive to subject the pixels to precharging and actual charging during a horizontal scan period for one line. In addition, when the gate drive means implements the gate 2 pulse drive, the source drive means adjusts the source voltage in actual charging in accordance with whether the pixels have identical or opposite polarities between frames.

Therefore, since precharging takes place before actual charging, differences due to the polarity in the preceding frame are small, and differences in charging to pixels after actual charging is completed are very small.

In addition, in a liquid crystal display of the present invention, the gate drive means implements a gate 2 pulse drive to subject the pixels to precharging and actual charging during a horizontal scan period for one line, and when the gate drive means implements the gate 2 pulse drive, the source drive means adjusts the source voltage in actual charging based on the polarity of the pixels in the preceding frame and the source output potential in precharging.

According to the invention, when the gate drive means implements the gate 2 pulse drive, the source drive means adjusts the source voltage in actual charging based on the polarity of the pixels in the preceding frame and the source output potential in precharging.

Therefore, the source voltage in actual charging is adjusted based on the polarity of the pixels in the preceding frame and the source output potential in precharging, which prevents differences in the potential charged to the pixels from developing due to the fact that the polarity may surely or may not change between frames.

In addition, in a liquid crystal display of the present invention, in the liquid crystal display driving pixels by active matrix drive at a frame frequency of 100 Hz or higher, there is provided polarity control means implementing, for each frame, a horizontal reversal once for a number of lines with respect to the polarity of the liquid crystal in the pixels.

In addition, a method of driving a liquid crystal display of the present invention, in a method of driving a liquid crystal display driving pixels by active matrix drive at a frame frequency of 100 Hz or higher, the polarity of the liquid crystal in the pixels is subjected to a horizontal reversal once for a number of lines for each frame.

In other words, when the conventional frame frequency of 50 Hz through 60 Hz is, for example, doubled to 100 Hz through 120 Hz to produce smooth moving images, if the polarity of the pixels was reversed every frame as in conventional art, the charge time would be halved, resulting in insufficient charging.

However, according to the present embodiment, the polarity control means subjects the polarity of the liquid crystal in the pixels to a horizontal reversal once for a certain number of lines for each frame.

Therefore, for example, when the frame frequency is double the conventional frame frequency, by implementing a horizontal reversal once every two lines, as a result, the same display quality as at the conventional frame frequency of 50 Hz through 60 Hz is achieved.

In addition, in the liquid crystal display of the present invention, the polarity control means implements a horizontal reversal while different types of horizontal reversals for a certain number of lines are mixed for each frame.

According to the invention, the polarity control means implements a horizontal reversal with different types of horizontal reversals once for a number of lines being mixed for each frame. Therefore, the reversal pattern is complex in comparison with conventional cases, and the nature of flickering becomes difficult to perceive in comparison with conventional cases.

In addition, in a liquid crystal display of the present invention, there is provided multiple-frame-unit control means subjecting the polarity of the liquid crystal in the pixels to a reversal with multiple frames as a unit.

According to the invention, multiple-frame-unit control means is provided; therefore, the polarity of the liquid crystal in the pixels can be reversed with multiple frames as a unit. A different reversal from the conventional once-per-frame reversal is implemented.

Therefore, a liquid crystal display is provided which addresses insufficient charging for higher display quality even at high frame frequencies.

In addition, in a liquid crystal display of the present invention, there is provided clock means multiplying a frame frequency of an input signal by k and frame interpolate means inserting an interpolated frame between frames.

According to the invention, the frame interpolate means inserts an interpolated frame between frames. Therefore, since interpolated frames are further inserted into video and other input signals, the display appears smooth.

In addition, the frame frequency of the input signal can be multiplied by k in the clock means. Therefore, any number of interpolated frames may be inserted between frames.

In addition, in a liquid crystal display of the present invention, there is provided overshoot drive means applying to the pixels a voltage corresponding to a higher grayscale level than a grayscale level represented by an input signal.

According to the invention, the overshoot drive means applies a voltage corresponding to a higher grayscale level than a grayscale level represented by an input signal to the pixels. Therefore, pixels are sufficiently charged at high frame frequencies.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display in which pixels are driven by active matrix drive, the display comprising:

a liquid crystal display screen composed of pixels arranged in a matrix, the liquid crystal display screen being divided into a first screen and a second screen;

gate driver to output a gate pulse to gate lines connected to gates of thin film transistors in the pixels, the gate driver being divided into a first gate driver to output a gate pulse to gate lines connected to gates of thin film transistors in pixels in the first screen and a second gate driver to output a gate pulse to gate lines connected to gates of thin film transistors in pixels in the second screen;

source driver to output a source voltage to source lines connected to sources of the thin film transistors in the pixels, the source driver being divided into a first source driver to output a source voltage to source lines connected to sources of the thin film transistors in the pixels in the first screen and a second source driver to output a source voltage to source lines connected to sources of the thin film transistors in the pixels in the second screen;

interframe polarity controller to control to alternately repeat, for each frame, a first reversal pattern where a polarity of liquid crystal in the pixels is subjected to a horizontal reversal once every m lines, m being 2 or a greater positive integer and a second reversal pattern where polarity reversal of lines in the first reversal pattern is shifted by n lines, n being a positive integer equal to a half or less of m.

2. The liquid crystal display as set forth in claim 1, wherein when implementing a horizontal reversal once every m lines, the gate driver regulates a width of the gate pulse on lines in the m lines during a horizontal scan period equivalent to m lines.

3. The liquid crystal display as set forth in claim 1, wherein the gate driver regulates a width of the gate pulse on lines in accordance with a polarity of pixels in a preceding line.

4. The liquid crystal display as set forth in claim 1, wherein the source driver regulates an output of the source voltage when implementing a horizontal reversal once every m lines.

5. The liquid crystal display as set forth in claim 4, wherein the source driver includes a source voltage switch to regulate the output of the source voltage by switching between predetermined two source voltages in accordance with a polarity of pixels in a preceding line.

6. The liquid crystal display as set forth in claim 1, wherein the active matrix drive has a frame frequency of 50 Hz or higher.

7. The liquid crystal display as set forth in claim 1, wherein the active matrix drive has a frame frequency of 100 Hz or higher.

8. The liquid crystal display as set forth in claim 1, wherein:

the gate driver implements a gate 2 pulse drive to subject the pixels to precharging and actual charging during a horizontal scan period for one line; and the source driver adjusts the source voltage in actual charging in accordance with whether the pixels have identical or opposite polarities between frames when the gate driver implements the gate 2 pulse drive.

9. The liquid crystal display as set forth in claim 1, wherein:

the gate driver implements a gate 2 pulse drive to subject the pixels to precharging and actual charging during a horizontal scan period for one line; and the source driver adjusts the source voltage in actual charging from a polarity of the pixels in a preceding frame and a source output potential in precharging when the gate driver implements the gate 2 pulse drive.

10. The liquid crystal display as set forth in claim 1, further comprising:

a clock to multiply a frame frequency of an input signal by k; and a frame interpolate generator to insert an interpolated frame between frames.

11. The liquid crystal display as set forth in claim 1, further comprising:

overshoot driver to apply to the pixels a voltage corresponding to a higher grayscale level than a grayscale level represented by an input signal.

12. The liquid crystal display as set forth in claim 1, further comprising:

multiple-frame-unit controller to subject the polarity of the liquid crystal in the pixels to a reversal with multiple frames as a unit.

13. The liquid crystal display as set forth in claim 12, further comprising:

a clock to multiply a frame frequency of an input signal by k; and a frame interpolate generator to insert an interpolated frame between frames.

14. The liquid crystal display as set forth in claim 12, further comprising:

overshoot driver to apply to the pixels a voltage corresponding to a higher grayscale level than a grayscale level represented by an input signal.

15. A liquid crystal display in which pixels are driven by active matrix drive, the display comprising:

a liquid crystal display screen composed of pixels arranged in a matrix, the liquid crystal display screen being divided into a first screen and a second screen;

gate driver to output a gate pulse to gate lines connected to gates of thin film transistors in the pixels, the gate driver being divided into a first gate driver to output a gate pulse to gate lines connected to gates of thin film transistors in pixels in the first screen and a second gate driver to output a gate pulse to gate lines connected to gates of thin film transistors in pixels in the second screen;

source driver to output a source voltage to source lines connected to sources of the thin film transistors in the pixels, the source driver being divided into a first source driver to output a source voltage to source lines connected to sources of the thin film transistors in the pixels in the first screen and a second source driver to output a source voltage to source lines connected to sources of the thin film transistors in the pixels in the second screen;

a frame frequency is 100 Hz or higher; and interframe polarity controller to control a polarity of liquid crystal in the pixels every so that a horizontal reversal for every two lines and a horizontal reversal for every line are alternately repeated for each frame.

16. The liquid crystal display as set forth in claim 15, wherein:

the gate driver implements a gate 2 pulse drive to subject the pixels to precharging and actual charging during a horizontal scan period for one line; and the source driver adjusts the source voltage in actual charging in accordance with whether the pixels have identical or opposite polarities between frames when the gate driver implements the gate 2 pulse drive.

17. The liquid crystal display as set forth in claim 15, wherein:

the gate driver implements a gate 2 pulse drive to subject the pixels to precharging and actual charging during a horizontal scan period for one line; and the source driver adjusts the source voltage in actual charging from a polarity of the pixels in a preceding frame and a source output potential in precharging when the gate driver implements the gate 2 pulse drive.

18. The liquid crystal display as set forth in claim 15, further comprising:

multiple-frame-unit controller to subject the polarity of the liquid crystal in the pixels to a reversal with multiple frames as a unit.

19. The liquid crystal display as set forth in claim 15, further comprising:

a clock to multiply a frame frequency of an input signal by k; and a frame interpolate generator to insert an interpolated frame between frames.

20. The liquid crystal display as set forth in claim 15, further comprising:

overshoot driver to apply to the pixels a voltage corresponding to a higher grayscale level than a grayscale level represented by an input signal.

21. A liquid crystal display in which pixels are driven by active matrix drive, the display comprising:

a liquid crystal display screen composed of pixels arranged in a matrix, the liquid crystal display screen being divided into a first screen and a second screen;

gate driver to output a gate pulse to gate lines connected to gates of thin film transistors in the pixels, the gate driver being divided into a first gate driver to output a gate pulse to gate lines connected to gates of thin film transistors in pixels in the first screen and a second gate driver to output a gate pulse to gate lines connected to gates of thin film transistors in pixels in the second screen;

source driver to output a source voltage to source lines connected to sources of the thin film transistors in the pixels, the source driver being divided into a first source driver to output a source voltage to source lines connected to sources of the thin film transistors in the pixels in the first screen and a second source driver to output a source voltage to source lines connected to sources of the thin film transistors in the pixels in the second screen;

a frame frequency is 100 Hz or higher; and polarity controller to subject for each frame, a polarity of liquid crystal in the pixels to a horizontal reversal once for a number of lines.

22. The liquid crystal display as set forth in claim 21, wherein the polarity controller implements, for each frame, a horizontal reversal with different types of horizontal reversals once for a number of lines being mixed.

23. The liquid crystal display as set forth in claim 22, further comprising:

a clock to multiply a frame frequency of an input signal by k; and a frame interpolate generator to insert an interpolated frame between frames.

24. The liquid crystal display as set forth in claim 22, further comprising:

overshoot driver to apply to the pixels a voltage corresponding to a higher grayscale level than a grayscale level represented by an input signal.

25. The liquid crystal display as set forth in claim 21, further comprising:

a clock to multiply a frame frequency of an input signal by k; and a frame interpolate generator to insert an interpolated frame between frames.

26. The liquid crystal display as set forth in claim 21, further comprising:

overshoot driver to apply to the pixels a voltage corresponding to a higher grayscale level than a grayscale level represented by an input signal.

27. A liquid crystal display in which pixels are driven by active matrix drive, the display comprising:

a liquid crystal display screen composed of pixels arranged in a matrix;

gate driver to output a gate pulse to gate lines connected to gates of thin film transistors in the pixels, the gate driver implementing a gate 2 pulse drive to subject the pixels to precharging and actual charging during a horizontal scan period for one line;

source driver to output a source voltage to source lines connected to sources of the thin film transistors in the pixels, the source driver adjusting the source voltage in actual charging in accordance with whether the pixels have identical or opposite polarities between frames when the gate driver implements the gate pulse drive;

interframe polarity controller to control to alternately repeat, for each frame, a first reversal pattern where a polarity of liquid crystal in the pixels is subjected to a horizontal reversal once every m lines, m being 2 or a greater positive integer and a second reversal pattern where polarity reversal of lines in the first reversal pattern is shifted by n lines, n being a positive integer equal to a half or less of m.

28. A liquid crystal display in which pixels are driven by active matrix drive, the display comprising:

a liquid crystal display screen composed of pixels arranged in a matrix;

gate driver to output a gate pulse to gate lines connected to gates of thin film transistors in the pixels, the gate driver implementing a gate 2 pulse drive to subject the pixels to precharging and actual charging during a horizontal scan period for one line;

source driver to output a source voltage to source lines connected to sources of the thin film transistors in the pixels, the source driver adjusting the source voltage in actual charging from a polarity of the pixels in a preceeding frame and a source output potential in precharging when the gate driver implements the gate 2 pulse drive;

interframe polarity controller to control to alternately repeat, for each frame, a first reversal pattern where a polarity of liquid crystal in the pixels is subjected to a horizontal reversal once every m lines, m being 2 or a greater positive integer and a second reversal pattern where polarity reversal of lines in the first reversal pattern is shifted by n lines, n being a positive integer equal to a half or less of m.

29. A liquid crystal display in which pixels are driven by active matrix drive, the display comprising:

a liquid crystal display screen composed of pixels arranged in a matrix, the liquid crystal display screen being divided into a first screen and a second screen;

gate driver to output a gate pulse to gate lines connected to gates of thin film transistors in the pixels, the gate driver implementing a gate 2 pulse drive to subject the pixels to precharging and actual charging during a horizontal scan period for one line;

source driver to output a source voltage to source lines connected to sources of the thin film transistors in the pixels, the source driver adjusting the source voltage in actual charging in accordance with whether the pixels have identical or opposite polarities between frames when the gate driver implements the gate pulse drive;

a frame frequency is 100 Hz or higher; and interframe polarity controller to control a polarity of liquid crystal in the pixels every so that a horizontal reversal for every two lines and a horizontal reversal for every line are alternately repeated for each frame.

* * * * *